US006849819B2

(12) United States Patent
Tresy et al.

(10) Patent No.: US 6,849,819 B2
(45) Date of Patent: Feb. 1, 2005

(54) HIGH-VOLTAGE OR MEDIUM-VOLTAGE SWITCH DEVICE WITH COMBINED VACUUM AND GAS BREAKING

(75) Inventors: Michel Tresy, Chassieur (FR); Michel Perret, Tramole (FR); Denis Dufournet, Sathonay Camp (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/454,526

(22) Filed: Jun. 5, 2003

(65) Prior Publication Data

US 2004/0004796 A1 Jan. 8, 2004

(30) Foreign Application Priority Data

Jun. 5, 2002 (FR) ..... 02 06911

(51) Int. Cl.[7] ..... H01H 33/14
(52) U.S. Cl. ..... 218/3; 218/7
(58) Field of Search ..... 218/3, 6, 7, 14, 218/16, 143, 70, 78, 153, 154

(56) References Cited

U.S. PATENT DOCUMENTS 5,170,023 A * 12/1992 Pham et al. ..... 218/143
5,905,242 A * 5/1999 Bernard et al. ..... 218/16

FOREIGN PATENT DOCUMENTS

| | | |
|---|---|---|
| EP | 1 117 114 A | 7/2001 |
| EP | 1 271 590 A | 1/2003 |
| JP | 59 214119 A | 12/1984 |
| JP | 61 121222 A | 6/1986 |
| WO | WO 97 08723 A | 3/1997 |

* cited by examiner

*Primary Examiner*—Elvin Enad
*Assistant Examiner*—M. Fishman
(74) *Attorney, Agent, or Firm*—Sughrue Mion, PLLC

(57) ABSTRACT

A hybrid high-voltage or medium-voltage breaker device includes an enclosure filled with a dielectric gas, a vacuum switch, a gas switch and an operating rod. The vacuum switch includes a fixed first arc contact and a second arc contact which can move in translation in an axial direction of the enclosure. The gas switch includes a fixed or quasi-fixed third arc contact and a fourth arc contact which can move in translation. The operating rod is connected to the fourth contact. The device also includes a connection arrangement for electrically connecting the second and third contacts and a displacement arrangement connected to the connection arrangement and to the rod which separates the second and fourth contacts from the first and third contacts, respectively.

19 Claims, 13 Drawing Sheets

HIGH-VOLTAGE OR MEDIUM-VOLTAGE SWITCH DEVICE WITH COMBINED VACUUM AND GAS BREAKING

BACKGROUND OF THE INVENTION

1. Field of the Invention

The invention relates to a hybrid high-voltage or medium-voltage switch device. The qualifier "hybrid" applies to the breaking action, which is of a mixed type in which two different breaking techniques cooperate. In particular, a switch device is qualified as a hybrid device if it includes a vacuum switch closing a first pair of arc contacts and further includes a gas switch comprising a second pair of arc contacts.

2. Description of the Prior Art

A device of the above type is disclosed in U.S. Pat. No. 3,038,980. It comprises an enclosure filled with a dielectric gas and having a longitudinal axis; the two switches are disposed inside the enclosure and electrically connected in series; the operating mechanism of the device is disposed outside the enclosure. The mechanism for actuating the contacts of the two switches is relatively simple, in the sense that one of the two contacts of the gas switch is attached to an adjacent mobile contact in the vacuum switch. The other contact of the gas switch is attached to an operating rod connected to the operating mechanism of the device. A spring mechanism associated with an abutment holds the contacts of the gas switch together over a first portion of their travel when the device is opened, until the contacts of the vacuum switch are separated by a particular distance. The object of this kind of sequence for separating the contacts of the two pairs is to be able to delay the separation of the contacts of the second pair (those of the gas switch) relative to those of the first pair (those of the vacuum switch).

However, the above kind of sequence is not satisfactory if the hybrid high-voltage breaker device combines a gas switch for a standard high voltage greater than 72.5 kV with a vacuum switch for a standard medium voltage less than 52 kV. In effect, as long as the contacts of the gas switch are not separated during the process of breaking a fault current by the device, the vacuum switch withstands all of the transient remaking voltage at the terminals of the breaker device during the separation of its contacts. Now, the vacuum switch is adapted only to withstand a remaking voltage which remains within the limits of the medium voltage. Accordingly, a high-voltage hybrid breaker device using the sequence described hereinabove to separate the contacts could break the current only after the separation of the two contacts of the gas switch. This operation implies a relatively long arcing time, which a vacuum switch is not designed to withstand. The general structure of the device described in U.S. Pat. No. 3,038,980 has no provision for modifying the sequence for separating the contacts. In particular, with the above kind of device it is not possible to obtain simultaneous or delayed separation of the contacts of the vacuum switch relative to separation of the contacts of the gas switch.

The patent application EP1109187 discloses another device of the above type, in which the contact separation sequence can be adjusted to obtain simultaneous or slightly delayed separation of the contacts of the vacuum switch relative to separation of the contacts of the gas switch. The mobile contact of the vacuum switch is connected to a link, one end of which is mobile in rotation, this end of the link, also known as the head of the link, being articulated to a crank of a flywheel that can be coupled to or decoupled from a toothed rod driven in translation by the operating rod of the gas switch.

The above device has some disadvantages from a mechanical point of view, however. First of all, it is necessary to exert a sufficient force on the mobile contact of the vacuum switch for as long as current is allowed to flow, in order to have a mutual pressure between the bearing surfaces of the contacts of this switch which is greater than a specified value, in order to resist electrodynamic forces while the current is flowing. The flywheel of the device must therefore be provided with a return spring system for exerting the required force on the mobile contact of the vacuum switch. On the other hand, the transmission of the movement from the operating rod of the gas switch to the vacuum switch is effected by means of a link whose axis is oblique to the axis of movement in translation of the mobile contact of the vacuum switch. This results in high transverse stresses on the vacuum switch, which can limit is mechanical durability.

Finally, the patent application EP1117114 describes another device of the above type which has the advantage over the preceding device that the mobile contact of the vacuum switch is always subjected to forces directed only in the direction of the longitudinal axis of the switch. Moreover, spring means are provided to maintain a mutual pressure between the contacts of the vacuum switch for as long as that switch is closed. However, the separation movement of the contacts of the vacuum switch is driven by the operating rod of the gas switch, with the result that the contacts of the vacuum switch must not separate until opening of the contacts of the gas switch is completed. The above device must have this kind of deferred contact separation sequence in order to cause a zero-crossing of the current before the vacuum switch alone breaks the current. In effect, the device is used exclusively as a generator circuit-breaker, and the gas switch is consequently present only to reduce the percentage asymmetry of the current.

It is obviously not possible with the above device to achieve simultaneous or slightly delayed separation of the contacts of the vacuum switch relative to separation of the contacts of the gas switch.

The invention aims first of all to remedy the disadvantages or limitations of the prior art techniques by proposing a high-voltage or medium-voltage hybrid breaker device that is relatively compact and durable and which, whilst operating with a single operating member, i.e. with an operating mechanism connected to only one operating rod, makes provision for adjusting the contact separation sequence of the switches in order to distribute adequately between the vacuum switch and the gas switch the transient remaking voltage that appears between the contacts of each switch as soon as they separate. The invention achieves the above objective by proposing a breaker device operating on the principle of the hybrid breaker device described in European patent application EP1271590A1 published on Jan. 2, 2003. The invention thereafter aims to prevent any bouncing movement of the mobile contact of the vacuum switch when a current is interrupted by the device, in order to prevent further arcing in the switch.

SUMMARY OF THE INVENTION

To this end, the invention provides a hybrid high-voltage or medium-voltage breaker device comprising:

an enclosure filled with a dielectric gas and having-a longitudinal axis, a vacuum switch disposed in the enclosure, including a first pair of arc contacts comprising a first contact which is fixed and a second contact which can be moved in translation in the axial direction of the enclosure, means adapted to exert on the second contact a force such that the mutual pressure between the bearing surfaces of the first and second contacts is greater than a particular value when the vacuum switch allows current to flow, a gas switch disposed in the enclosure, including a second pair of arc contacts comprising a third contact which is fixed or quasi-fixed and a fourth contact which can be moved in translation in the axial direction, an operating rod connected to the fourth contact and adapted to be immobilized or moved in translation by operating means, which device further comprises:

connection means for electrically connecting the second contact and the third contact, adapted to be moved in translation in the longitudinal axial direction conjointly with the second contact, displacement means connected to the connection means and to the operating rod to move them to separate the second and fourth contacts from the first and third contacts, respectively, comprising dead travel connecting means connecting the connection means to the rod, the dead travel connecting means moving the rod over a particular dead travel at the same time as operating on the connection means to hold the vacuum switch closed during the movement, and in which device, when the dead travel has been completed by the rod, the dead travel connecting means are adapted to acquire a movement in translation in the axial direction which is independent of the movement acquired simultaneously by the connection means.

Advantageously, for applications in which the device according to the invention is intended for use as a circuit-breaker in a high-voltage network, the displacement means are such that the respective contacts of the vacuum switch and the gas switch separate simultaneously or with a short time-delay.

Moreover, a particular embodiment of the invention aims to achieve efficient arc blow-out in the gas switch, including if the hybrid switch device is intended to withstand at its terminals a transient remaking voltage with a very high remaking speed, as is often the case in high-voltage and very-high-voltage applications, and in particular if the currents to be broken are less than approximately 30% of the breaking capacity of the hybrid device. In this embodiment, in addition to the features of the invention defined hereinabove, the hybrid breaker device comprises a top-up pneumatic blast volume adjacent and able to communicate with the thermal blast volume, and delimited by a fixed or mobile bottom which is adapted to be moved toward the thermal blast volume to compress the dielectric gas contained in the pneumatic blast volume during interruption of current by the breaker device. The top-up pneumatic blast volume blows out the arc if the current to be broken is not high enough to generate the necessary pressure rise in the thermal blast volume by thermal means.

Particular embodiments of a breaker device according to the invention can comprise one or more of the following features in isolation or in all technically possible combinations:

the dead travel connecting means comprise movement transmission means which cooperate with first spring means adapted to act on the connection means to hold the vacuum switch closed and comprise first abutment means on which the first spring means bear to exert a force on the connection means, the first abutment means being adapted to cancel the force once the dead travel has been completed, the movement transmission means comprise two portions adapted to be moved conjointly, bearing one against the other, and to be dissociated after the vacuum switch begins to open, the first abutment means comprise at least one dead travel rod which is constrained to move with a first portion of the movement transmission means and which has at one end a head, and comprise a first tubular bearing member which is adapted to be moved in the axial direction along a fixed support member which surrounds it, the first tubular member having an annular portion through which the dead travel rod passes and against which the head is adapted to abut when the dead travel has been completed, the displacement means comprise second spring means adapted to separate the contacts of the vacuum switch as soon as the operating rod has completed the dead travel and to move the connection means and the second contact over a particular isolating travel relative to the first contact when a current is interrupted by the device, the isolating travel corresponding to the distance of complete separation of the first and second contacts, the first spring means comprise a first spring which is compressed between the annular portion of the first tubular bearing member and the first portion of the movement transmission means, the second spring means comprise a second spring compressed between a second portion of the fixed support member and an annular portion of a second tubular bearing member which surrounds the fixed support member, the second tubular bearing member being adapted to be moved along the second fixed support member in the axial direction and being fastened by at least one tie-rod to a main portion of the connection means, the first and second tubular bearing members are stationary, bearing one against the other, for as long as the dead travel has not been completed by the operating rod during interruption of current by the device, the second portion of the fixed support member is provided with second abutment means against which the main portion of the connection means abuts when the latter have completed the isolating travel, the first portion of the fixed support member supports the third arc contact and is supported by the second portion of the fixed support member by virtue of fixing means disposed along the axis of the device, the second portion being fixed in position by an insulative tie-rod which is fixed to one end of the device, a second portion of the movement transmission means is constrained to move in translation with the operating rod, a varistor is disposed in the common enclosure of the breaker device and electrically connected in parallel to the contacts of the vacuum switch in order to be able to limit the voltage applied to the switch, with a view to adequately distributing the voltage applied to the vacuum and gas switches when the breaker device opens, and a capacitor is connected in parallel to one of the switches or in parallel to each of the switches, with a view to obtaining this adequate distribution.

For applications in which the device according to the invention is intended for use as a generator circuit-breaker in a medium-voltage network, the displacement means are preferably adapted so that the separation of the contacts of the vacuum switch is significantly delayed relative to the separation of the arc contacts of the gas switch, so that the zero-crossing of the current is caused by the gas switch before the vacuum switch breaks the current.

The invention, its features and its advantages are explained in the following description with reference to the following figures.

FIGS. 1 to 14 and 14' correspond to embodiments of hybrid breaker devices operating on the principle of the breaker device described in the European patent application EP1271590A1. However, these embodiments do not incorporate any improvement according to the present invention aimed at preventing any bouncing movement of the mobile contact of the vacuum switch. Embodiments with such improvements are described hereinafter with reference to FIGS. 15 to 20.

BRIEF DESCRIPTION OF THE DRAWINGS

FIG. 8 is a diagrammatic representation of one embodiment of a hybrid breaker device of which FIG. 1 is a simplified theoretical diagram.

FIG. 14' is a diagrammatic representation of one embodiment of a hybrid breaker device in which the spring means comprise two springs disposed one on each side of direction changer means.

DETAILED DESCRIPTION OF THE PREFERRED EMBODIMENTS

Figure 1:
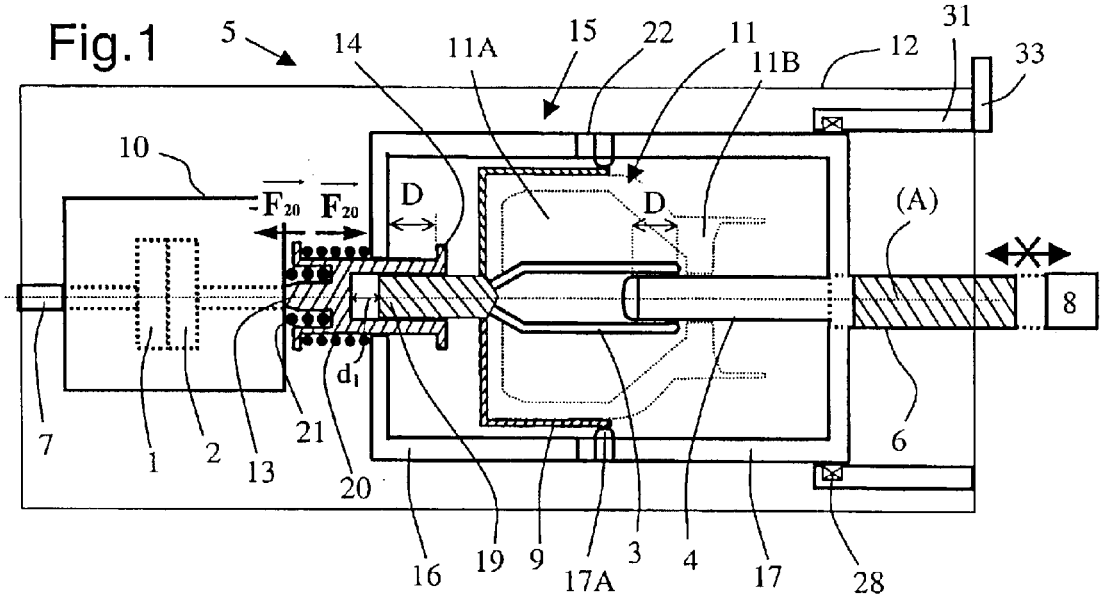
FIG. 1 is a simplified theoretical diagram showing the main components of one particular embodiment of a high-voltage or medium-voltage hybrid breaker device, shown closed.

The hybrid breaker device 5 shown in FIG. 1 exhibits global symmetry of revolution about an axis A. It includes a vacuum switch 10 containing a first pair of arc contacts 1 and 2. A first contact 1 is fixed and is permanently connected to an end bushing 7 of the device 5. A second contact 2 is mobile in the axial direction A. The device also includes a gas switch 11 electrically connected in series with the vacuum switch. The gas switch comprises a second pair of arc contacts consisting of third and fourth contacts 3 and 4. The third contact 3 is fixed into the enclosure 12 by retaining means shown in FIGS. 8 and 9. The fourth contact 4 is mobile in the axial direction A and attached to an operating rod 6 connected to the operating mechanism 8 of the device 5. The two switches 10 and 11 are disposed in a common enclosure 12 filled with a dielectric gas.

In the embodiment shown, the mobile contact 4 is inserted into the fixed contact 3 to a particular overlap distance when the breaker device is closed. By virtue of this overlap, the third and fourth contacts separate at a moment at which the operating rod 6 has traveled a particular distance, referred to as the acceleration distance, which amounts to saying that the overlap distance corresponds to the acceleration distance that the rod 6 travels. The acceleration is applied to the mobile contact 4 of the gas switch and is such that the contact 4 separates from the fixed contact 3 at a relatively high speed as soon as separation begins. A few milliseconds after the separation, the speed can reach a value sufficient to extinguish the electrical arc created between the contacts of the switch. This is particularly useful for breaking so-called capacitive currents without electrical arcing.

The contact 2 is constrained to move in translation with mobile connecting means 13 which electrically connect it to the fixed contact 3 at all times. The fact that the third contact is fixed in the breaker device means that the separation of the contacts 3 and 4 in the gas switch does not depend on the mechanical operation of the assembly carrying the second mobile contact of the vacuum switch.

Movement transmission means 15 can be separated into two parts 16 and 17. These two parts bear one against the other in the axial direction A via coupling means 22 provided at their two facing ends. The second part 17 is constrained to move in translation with the rod 6 and the first part 16 can be moved in translation over a particular travel D in the axial direction A relative to the connecting means 13. In the embodiment shown, this travel D is equal to the overlap distance of the contacts 3 and 4, which amounts to saying that it is equal to the acceleration distance previously defined.

The transmission means 15 can also be provided by a telescopic connection, not shown, comprising two parts that can be immobilized when abutted one against the other and which slide one within the other during their separation in the axial direction, a telescopic connection of this kind being functionally equivalent to the transmission means 15 shown diagrammatically in FIG. 1. However, this kind of arrangement can have drawbacks because of the increased moving masses.

First spring means are provided for holding the vacuum switch closed by applying to the connection means 13, and therefore to the contact 2, a first thrust which remains above a particular threshold until the rod 6 has completed the travel D.

Figure 2:
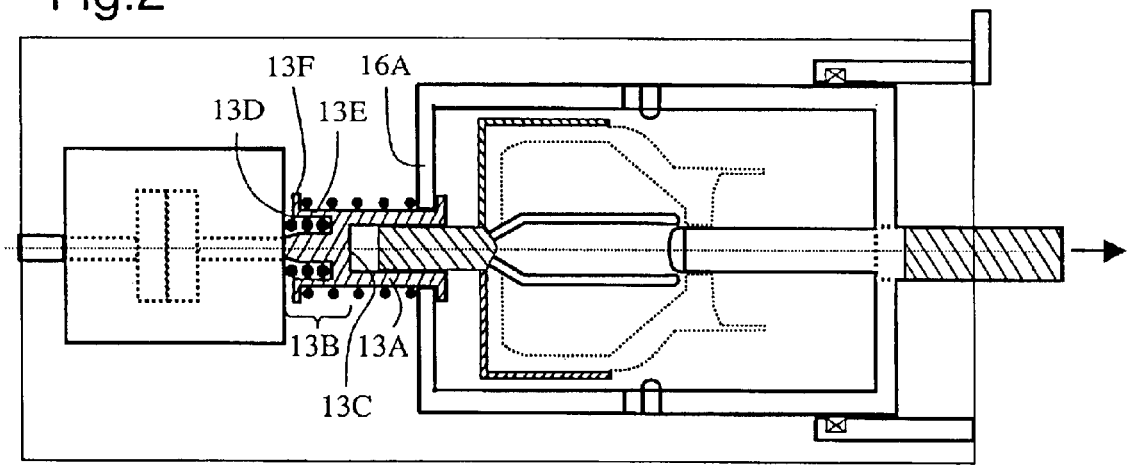
FIGS. 2, 3 and 4 represent successive steps in the opening of the hybrid breaker device shown in FIG. 1.

At this moment, which is represented in FIG. 2, the contacts of the gas switch separate. This first thrust ceases to act on the connection means at this moment, to allow second spring means which exert a second thrust in the opposite direction to act on the contact 2. This second thrust moves the contact 2, which causes the contacts of the vacuum switch to separate. Thus this separation occurs simultaneously with or delayed with respect to separation of the contacts of the gas switch, in a particular sequence.

In the device described, the first and second spring means for exerting the first and second thrusts respectively comprise a first spring 20 and a second spring 21, both of which are armed in compression and which are respectively associated with first and second abutment means 14 and 19. The first spring 20 is mounted between the connection means 13 and the first portion 16, to exert respective opposite thrusts $-\overline{F20}$ and $\overline{F20}$ on these members. In the closed configuration of the breaker device 5, the rod 6 is immobilized by the operating mechanism 8, so that the two portions 16 and 17 can be held stationary, pressed one against the other, and also so that a particular pressure can be maintained on the contacts 1 and 2 by the first spring 20 associated with the connection means 13. This contact pressure enables the switch to pass a fault current and depends on the value of the fault current it is to withstand.

If an instruction to interrupt the current is sent to the operating mechanism 8 of the breaker device 5, the rod 6 must be released to allow the first portion 16 to be moved in translation relative to the means 13 by the expansion of the first spring 20. This relative movement is stopped, as soon as the first portion 16 has completed the travel D, by the first abutment means 14, which form one end of the connection means 13, so that this portion 16 is constrained to move in translation with the means 13, as shown in FIG. 2.

The transmission means 15 and the first spring means form a connecting system which connects the connection means 13 to the rod 6. This system can be regarded as constituting dead travel connecting means in the sense that it does not allow the connection means to follow the movement of the rod until the latter has completed a particular travel. During this travel D, the connection means 13 remain stationary because the transmission means 15 do not transmit the movement of the rod 6 to them. This applies both to opening and to closing of the breaker device.

When the contacts 1 and 2 of the vacuum switch 10 separate, the contact 2 is moved by the semi-mobile second spring 21, one end of which is immobile because it bears at all times against the face of the vacuum switch through which passes the rod carrying the contact 2. The other end of the spring 21 is mobile, bearing at all times against the connection means 13, to which it applies a thrust which remains very much lower than that of the first spring 20.

The dead travel connecting means cooperate with the second spring means to move the rod 6 and the connection means 13 to separate the mobile contacts 2 and 4 from the fixed contacts 1 and 3, respectively. In the embodiment shown, they are a component part of the displacement means whereby the contacts 1 and 2 and the contacts 3 and 4 of the vacuum and gas switches, respectively, separate simultaneously or with a short time-delay.

Figure 3:
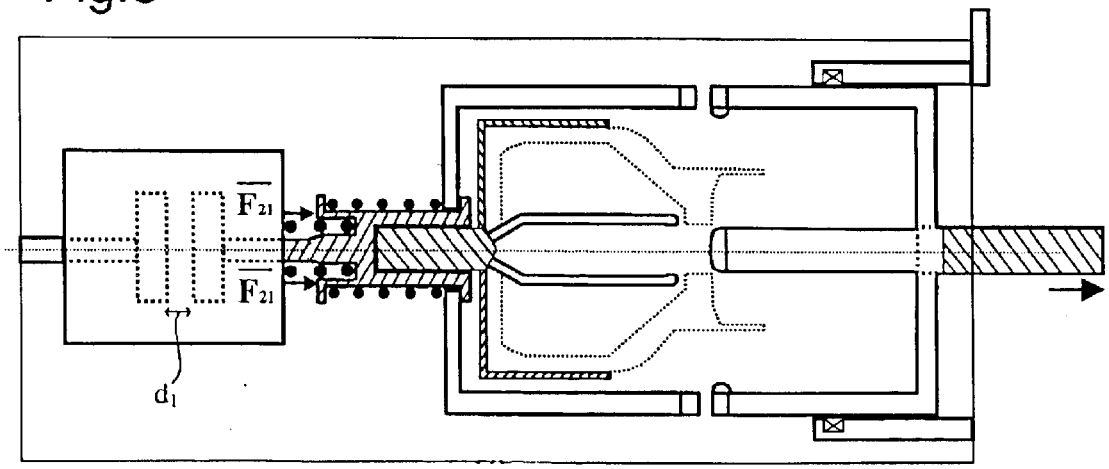

The second abutment means 19 are disposed to halt the movement in translation of the connection means 13 as soon as they have completed a particular travel $d_1$, as shown in FIG. 3. The abutment means 19 are electrically and mechanically connected to the fixed contact 3 and advantageously contribute to the electrical connection between the contacts 2 and 3. Here they comprise a cylindrical stud concentric with the axis A which is introduced into a hollow tubular portion of the mobile connection means 13, which can therefore slide in the axial direction A. They are further electrically and mechanically connected to a conduction member 9 which surrounds and retains a blast chamber disposed in the axial direction A. As is known in the art, this chamber comprises a thermal blast volume 11A and a blast nozzle 11B. The blast nozzle 11B is intended to blow out an electrical arc between the contacts of the gas switch through thermal expansion of the dielectric gas contained in the blast volume 11A.

The conduction member 9 serves as a main contact for the permanent current flow when the breaker device 5 is closed. The electrical connection between the member 9 and a current terminal 33 is provided by a sliding contact 17A supported by the second portion 17 of the transmission means 15 at the location of the coupling means 22. The second portion 17 is electrically conductive and moves in translation with the rod 6 but remains in electrical contact through a sliding contact 28 with a fixed conductive tube 31 connected to the terminal 33. The first portion 16 of the transmission means 15 is electrically insulated for reasons explained hereinafter.

In the embodiment shown, the connection means 13 comprise a metal bush featuring circular symmetry in the axial direction A. The reference numbers for the various component parts of this member are shown in FIG. 2. The bush has a hollow tubular portion 13A which has at its open end a first annular shoulder constituting the first abutment means 14. This hollow portion 13A has a bottom 13C adapted to bear against the cylindrical stud constituting the second abutment means 19. The bush also has a cylindrical portion 13B in which there is formed an annular housing 13D open toward the vacuum switch 10 and adapted to accommodate the second spring 21. The wall 13E around this housing 13D has at its end a second annular shoulder 13F providing an abutment for the first spring 20. The spring 20 is compressed at all times between this shoulder 13F and an annular wall 16A that constitutes one end of the first portion 16. The inside diameter of the wall 16A is substantially equal to the outside diameter of the tubular portion 13A of the bush 13, so that the portion 16 can slide along the bush in the axial direction A.

After the rod 6 is released, the first portion 16 of the transmission means 15 moves in translation from the position represented in FIG. 1 to that represented in FIG. 2. As it moves, it pushes the second portion 17, and the sliding contact 17A is adapted to separate from the conduction member 9 in order for the fault current to flow exclusively via the arc contacts 3 and 4 in the gas switch 11. As previously mentioned, the first portion 16 is electrically insulative or at least electrical insulates the connection means 13 and the second portion 17, which is conductive, from each other. In effect, if this portion 16 were entirely conductive, electrical arcs would appear between the portions 16 and 17 after the sliding contact 17A is disconnected from the conduction member 9.

The movement in translation of the transmission means 15 is transmitted to the rod 6 and consequently to the mobile contact 4 of the gas switch. The thrust provided by the expansion of the first spring 20 assists the operating mechanism 8 to operate the rod.

FIG. 2 shows the device at the moment at which the annular wall 16A of the first portion 16 comes into abutment against the first abutment means 14, after traveling the distance D. The mobile contact 4 in the gas switch has simultaneously traveled the same distance D and is on the point of separating from the fixed contact 3. At this stage, the thrust $-\overline{F20}$ of the first spring 20 can no longer operate effectively on the connection means 13 to maintain the pressure on the contact 2, and the thrust of the second spring 21 is free to act on the means 13 to move them in translation. The mobile contact 2 in the vacuum switch 10 is then on the point of separating from the fixed contact 1, at the same time as the contacts 3 and 4 separate in the gas switch.

The connection means 13 are moved between the positions represented in FIGS. 2 and 3 by the expansion of the second spring 21, which applies a thrust $\overline{F21}$ to the means 13 at all times, as shown in FIG. 3. This movement leads, on the one hand, to movement of the second contact 2, to open the vacuum switch 10 and, on the other hand, to continued movement in translation of the transmission means 15.

In FIG. 3, the movement of the contact 2 in the vacuum switch 10 is stopped as soon as the contact has separated completely from the contact 1. Complete separation is obtained when the mobile contact 2 is separated from the fixed contact 1 by a particular vacuum insulation distance, for example of the order of 15 mm. To this end, the movement of the connection means 13 is stopped by the second abutment means 19, which are disposed so that the travel $d_1$ completed by the means 13 is equal to the insulation distance corresponding to complete separation of the contacts 1 and 2. Hereinafter, this travel $d_1$ is also referred to as the insulation travel.

The thrust $\overline{F21}$ of the second spring 21 is initially sufficient to supply the energy necessary for the movement of the contact 2 and the members 13 and 16 constrained to move together in translation and thereafter sufficient to maintain the contacts 1 and 2 open, as shown in FIG. 3. Nevertheless, this thrust normally remains very much lower than the thrust $F_{20}$ of the first spring 20. In effect, as long as the vacuum switch 10 then remains closed, as shown in FIGS. 1 and 2, the pressure to be maintained on the contacts 1 and 2 is relatively high, for example of the order of 2 000 N for a fault current of 40 kA. The thrusts $F_{20}$ and $F_{21}$ of the first and second springs are therefore made to have a difference $\Delta F=F_{20}-F_{21}$ that remains above a particular threshold S. $F_{20}$ decreases between the times corresponding to FIGS. 1 and 2, whereas $F_{21}$ is stable at its maximum value, $F_{20}$ remaining sufficiently high to satisfy the condition $F_{20}>F_{21}+S$.

In one version of the mechanism 8 for operating the rod 6 that opens the switches, the rod is driven in translation by the mechanism 8 at a speed higher than that imparted to the connection means 13 by the expansion of the second spring 21. The device shown in FIGS. 1 to 4 operates with this configuration. The portions 16 and 17 of the transmission means 15 are in this case adapted to separate before the means 13 reach their abutment, i.e. before the contacts 1 and 2 are completely separated at the time corresponding to FIG. 3. For example, the portions 16 and 17 can start to separate just after the contacts 1 and 2, i.e. just after the time corresponding to FIG. 2. In this way, only a first phase of the movement in translation of the contact 2 is transmitted to the rod 6 by the transmission means 15. After this first phase, which can be very short, the transmission means 15 therefore exert no further action on the rod 6 to assist with moving it in translation, and this movement is then provided entirely by the operating mechanism 8. This mode of operation increases the speed of the mobile contact 4 at the moment of blowing out the arc between the contacts 3 and 4 in the gas switch 11.

Figure 4:
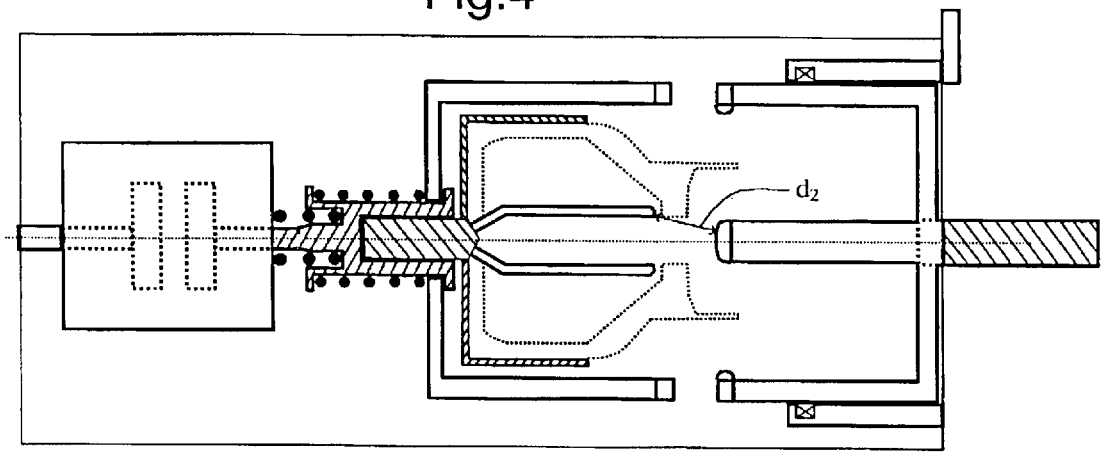

The contacts 1 and 2 are held open in the vacuum switch 10 until the contacts 3 and 4 in the gas switch have opened completely, as shown in FIG. 4, in which these contacts are separated by a particular insulation distance $d_2$ at the end of the travel of the mobile contact 4. The distance $d_2$ is generally from 80 mm to 200 mm for most gas blast switches, which means that this distance $d_2$ is very much greater than the insulation travel $d_1$ previously referred to for the vacuum switch.

Figure 5:
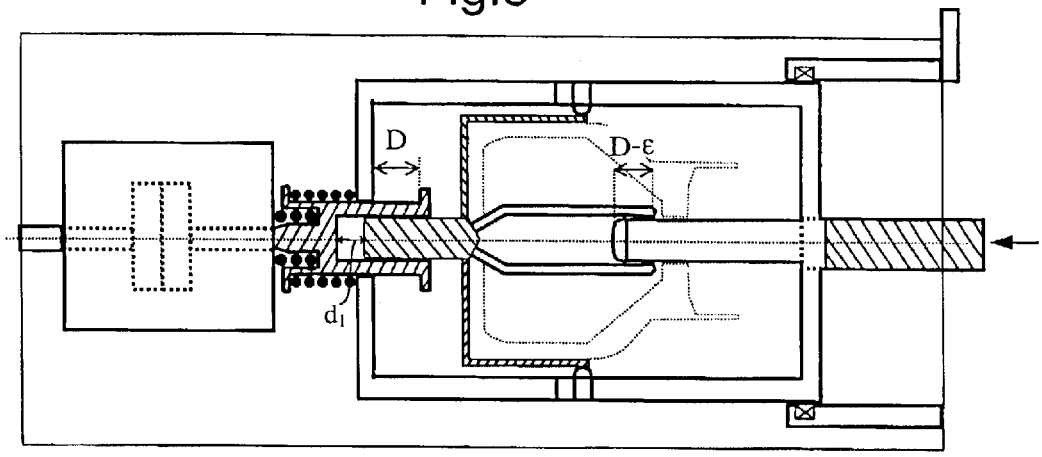
FIG. 5 represents the theoretical diagram of a hybrid breaker device identical to that shown in FIG. 1, with the exception that the contacts of the gas switch are adapted to separate slightly before the contacts of the vacuum switch.

FIG. 5 represents the theoretical diagram of a device identical to that shown in FIG. 1, except that the contacts of the gas switch are adapted to separate slightly before the contacts of the vacuum switch. To separate the contacts of the gas switch in advance in this way, it is sufficient for the overlap distance of these contacts to be slightly less than the travel D previously defined when the breaker device is closed. There is therefore an overlap distance, in other words an acceleration distance for the rod 6, equal to $D-\epsilon$, where the distance $\epsilon$ is a function of the required time-delay for this in advance separation.

Figure 6:
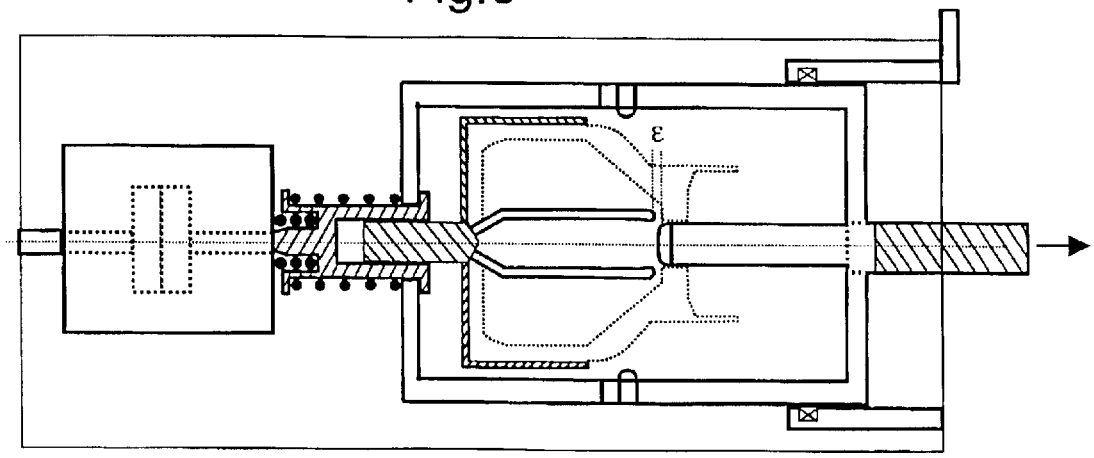
FIG. 6 shows an intermediate step of the opening of the hybrid breaker device shown in FIG. 5.

In FIG. 6, at the moment the rod 6 has completed the particular travel D, the contacts of the gas switch have just separated and the distance between them is the distance $\epsilon$. It can therefore be seen that this distance $\epsilon$ is defined as the required separation of the contacts of the gas switch at the moment when the contacts of the vacuum switch are on the point of separating.

Figure 7:
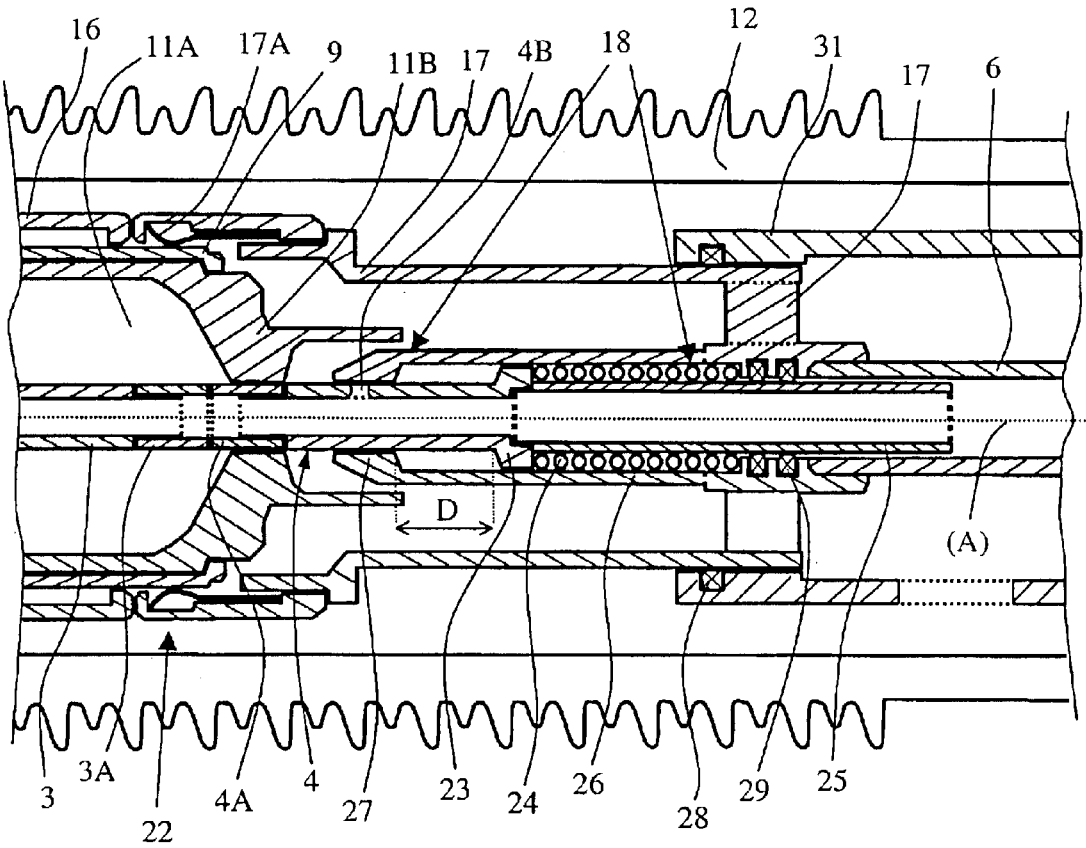
FIG. 7 is a view to a larger scale of a portion of the hybrid breaker device shown in FIG. 9.
Figure 9:
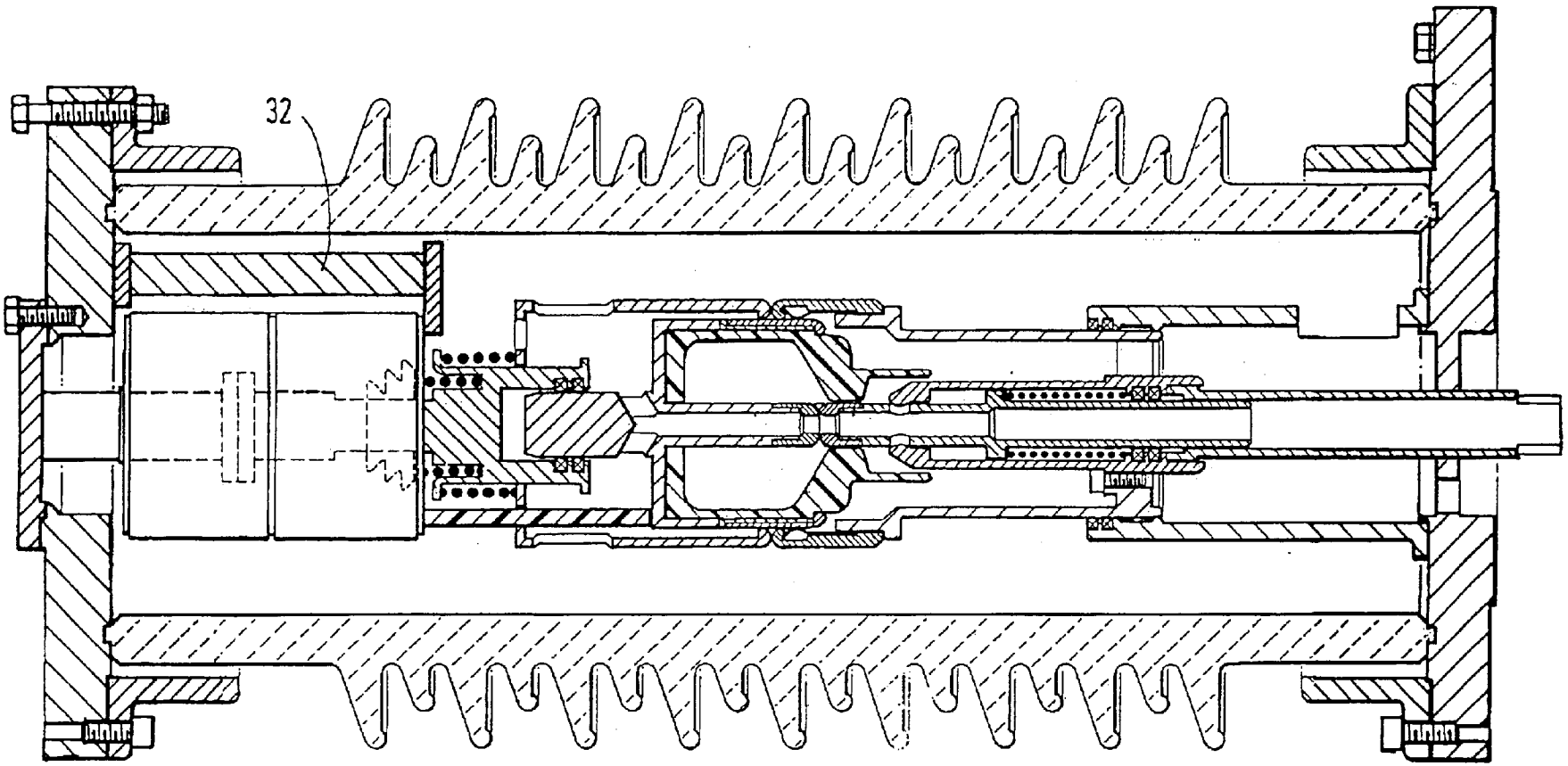
FIG. 9 is a diagrammatic representation of another embodiment of a hybrid breaker device in which the contacts of the gas switch are disposed end-to-end.

FIG. 7 is a partial view to a larger scale of the hybrid breaker device shown in FIG. 9, when closed. This view shows a second embodiment of a breaker device, in which the contacts 3 and 4 of the gas switch 11 are pressed together with a particular contact pressure provided by spring means to resist electrodynamic forces when the current is flowing.

Means 18 for delaying the onset of movement of the mobile contact 4 are disposed between that contact and the operating rod 6 of the device, so that the contacts 3 and 4 are separated by the movement of the contact 4 exactly at the moment the rod 6 has traveled the acceleration distance previously defined.

The rod 6 and the contacts 3 and 4 are preferably of tubular shape in the axial direction A and the contacts 3 and 4 advantageously each have at their end a respective endpiece 3A and 4A made from a refractory conductive material. The arc contact 4 also incorporates orifices or openings 4B for evacuating hot gases at increased pressure inside the tubular structure of the contact during the breaking of a fault current by the arc contacts 3 and 4. The pressurized gases are evacuated into the space between the delay means 18 and the second portion 17, and then pass into the space between the rod 6 and the conductive tube 31 through openings provided for this purpose in the second portion 17. Finally, these gases undergo a final expansion on passing into the volume adjacent the interior wall of the enclosure 12 via openings formed for this purpose in the conductive tube 31. Other arrangements of openings for evacuating the pressurized gases can of course be provided.

The delay means 18 comprise:

a first tubular member 25 axially aligned with the contact 4, firmly attached to the latter and able to slide inside the rod 6 when the latter moves, the acceleration distance for the rod 6 being defined by the authorized travel for this sliding motion, third abutment means 23 fixed to one end of the tubular member 25 at the location of the connection with the contact 4, a second tubular member 26 firmly attached by one end to the second portion 17 of the transmission means 15, having a diameter greater than that of the tubular member 25, able to slide along the third abutment means 23 in the axial direction A when the rod 6 moves, and having at its other end an annular cap 27 adapted to bear against the abutment means 23, and a third spring 24 disposed in the axial direction A, inserted between the first and second tubular members, and bearing at one end against the third abutment means 23 and at the other end against the second portion 17 of the transmission means 15.

In the embodiment shown, the delay means 18 are such that the acceleration distance is equal to the travel D of the transmission means 15 relative to the connection means 13, to obtain simultaneous separation of the two pairs of contacts.

When a current is broken by the device, once the sliding contact 17A is disconnected from the conduction member 9, and before separation of the contacts 3 and 4, the fault current flows from the fixed contact 3 to the conductive tube 31 via the contact 4, the tubular member 25, the sliding contacts 29, a portion of the second part 17 of the transmission means 15, and, finally, the sliding contacts 28.

During the common movement in translation of the portions 16 and 17 of the transmission means 15, the mobile contact 4 is pressed against the fixed contact 3 with a particular contact pressure by the thrust exerted by the third spring 24. When the rod 6 has traveled the acceleration distance, the annular cap 27 bears against the abutment means 23. The spring 24 no longer exerts any action on the contact 4, which from this moment is entrained in translation with the rod 6 and the second portion 17. Accordingly, the mobile contact 4 is constrained to move in translation with the parts 6 and 17 only from a given time starting from the time at which the device is tripped.

The operation of the device is analogous to that of the device shown in FIG. 1, and achieves separation of the contacts 3 and 4 in the gas switch simultaneously with that of the contacts 1 and 2 in the vacuum switch. It is nevertheless possible for the contacts of the gas switch to separate in advance by arranging the components of the device so that the acceleration distance is less than the distance D, in an analogous fashion to the arrangement shown in FIG. 5.

Figure 8:
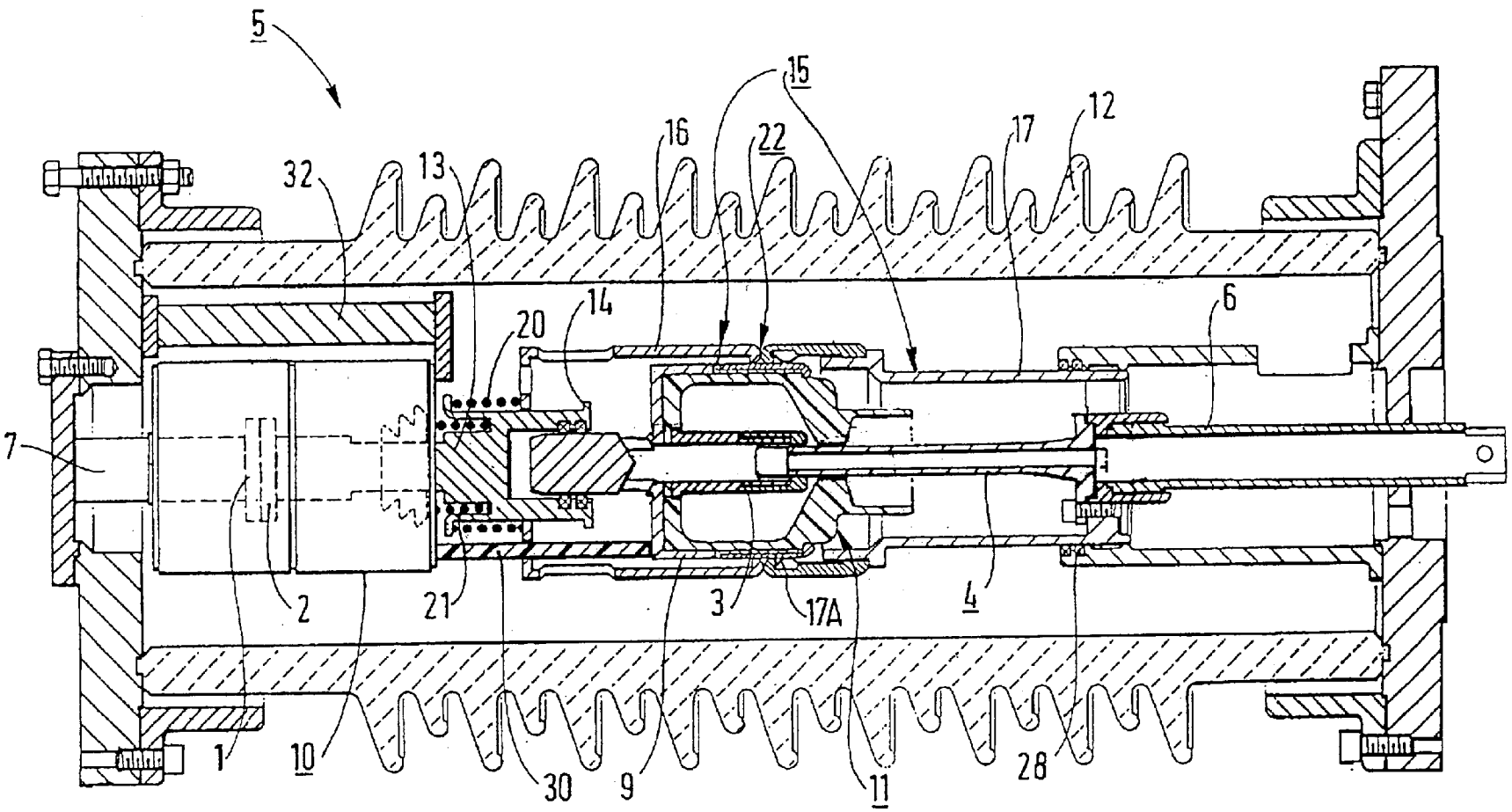

FIG. 8 is a diagrammatic representation of one embodiment of a hybrid breaker device for which FIG. 1 represents a simplified theoretical diagram. The contacts of the gas switch are nested one within the other with a particular overlap distance when the breaker device is closed, as in FIG. 1.

The volume adjacent the interior wall of the enclosure common to the two switches is dimensioned to accommodate a varistor 32 electrically connected in parallel to the contacts of the vacuum switch in order to limit the voltage applied to the switch. This adequately distributes the voltage applied to the vacuum and gas switches when the breaker device opens. The voltage distribution can also be adjusted by means of at least one capacitor connected in parallel to the breaker device or in parallel to one of the two switches.

In the case of air-insulated switchgear, of the kind shown, in which breaker devices in series can be accommodated in a vertical insulative enclosure, it may be advantageous to dispose the vacuum switch in the portion of the enclosure that is farthest from the ground. This achieves a natural voltage distribution that gives a higher voltage at the gas breaker device than the voltage applied to the vacuum switch. Also, the relative compactness of hybrid devices like those shown herein enables the use of an existing insulative enclosure provided for a non-hybrid gas switch.

The electrical connection between the varistor 32 and the mobile contact of the vacuum switch is provided by a metal bellows sealing the switch. The electrical connection between the connection means 13 and the conductive stud forming the second abutment means 19 is provided by sliding contacts. Orifices or openings are provided at the location of the connection between the stud and the conduction member 9 which surrounds the blast chamber of the gas switch, to enable evacuation of hot gases, as explained in the commentary on FIG. 7. Openings of this kind are also provided in the first and second portions 16 and 17 of the transmission means 15, as well as in the conductive tube in which the second portion can slide.

Electrically insulative tie-rods 30 contribute to the mechanical retention of the gas switch within the enclosure of the breaker device. These tie-rods are fixed by one end to the face of the vacuum switch through which passes the rod carrying the mobile contact. They are rigidly connected by their other end to the conduction member 9 and thus hold the third contact fixed in position in the gas switch.

The operating rod 6 of the device is rigidly connected to the mobile contact 4 and to the second portion 17 of the transmission means 15. The three members 6, 4 and 17 are therefore constrained to move together in translation at all times in this embodiment.

FIG. 9 is a diagrammatic representation of another embodiment of a hybrid breaker device, shown closed, in which the contacts of the gas switch are disposed end-to-end. Many components are identical to those of the embodiment shown in FIG. 8. Nevertheless, the different structure of the contacts of the gas switch means that the mobile contact of this switch cannot be driven in as direct a fashion as in the embodiment in which these contacts are nested one within the other. To comply with the required sequence of opening of the switches, delay means 18 such as those shown in detail in FIG. 7 are provided to delay the onset of movement of the mobile contact. These means enable the rod 6 to travel the acceleration distance as previously explained, and thereby enable the mobile contact 4 to be driven by the rod 6 at a high speed when separation of the contacts of the vacuum switch begins, as in the embodiment with nested contacts.

Figure 10:
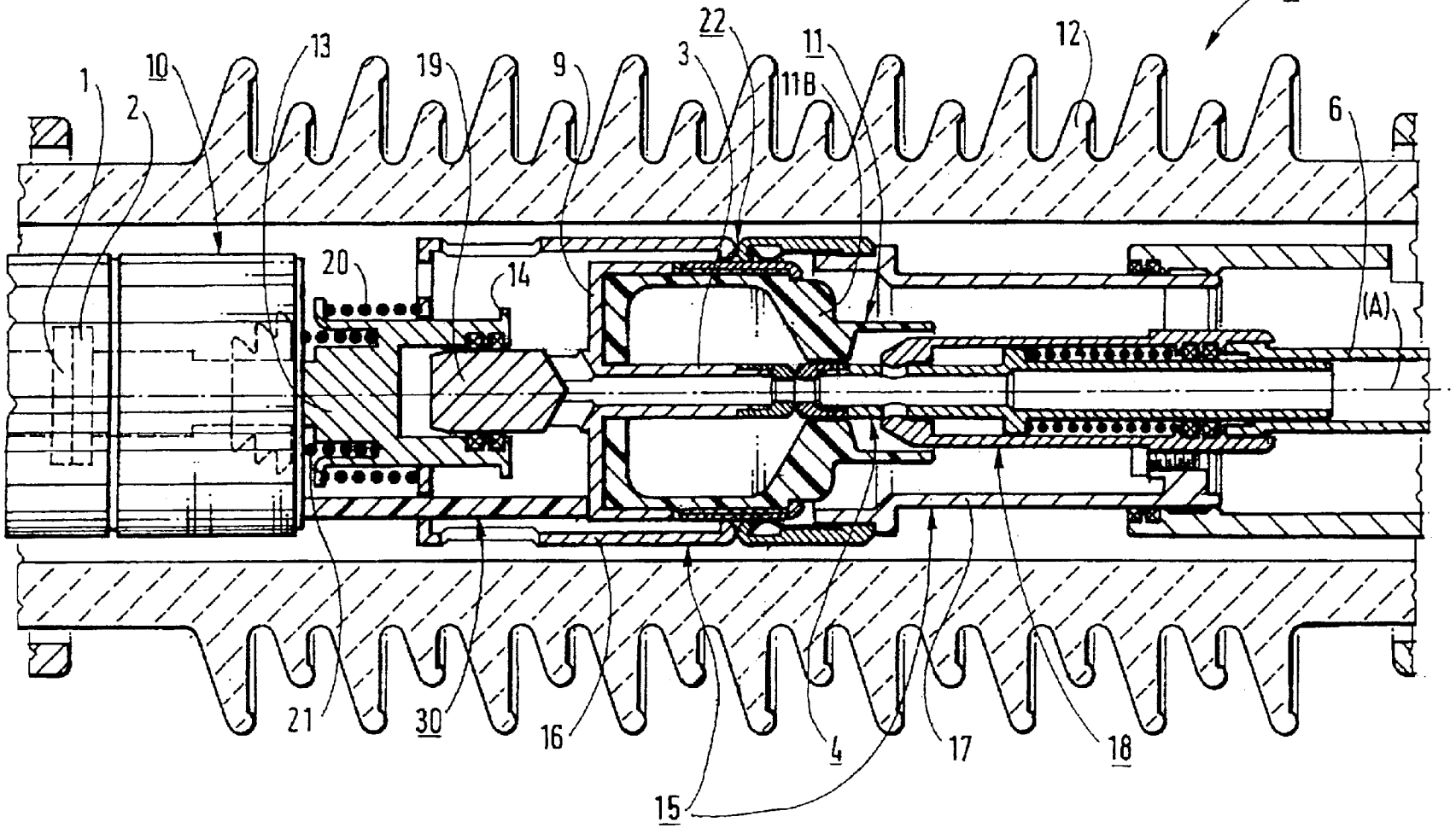
FIG. 10 is a partial view of the hybrid breaker device shown in FIG. 9 with the varistor removed.

The components of the hybrid breaker device shown in FIG. 10 are identical to those shown in FIG. 9, except for the varistor, which has been removed, and the insulative enclosure, whose diameter has been reduced accordingly.

Figure 11:
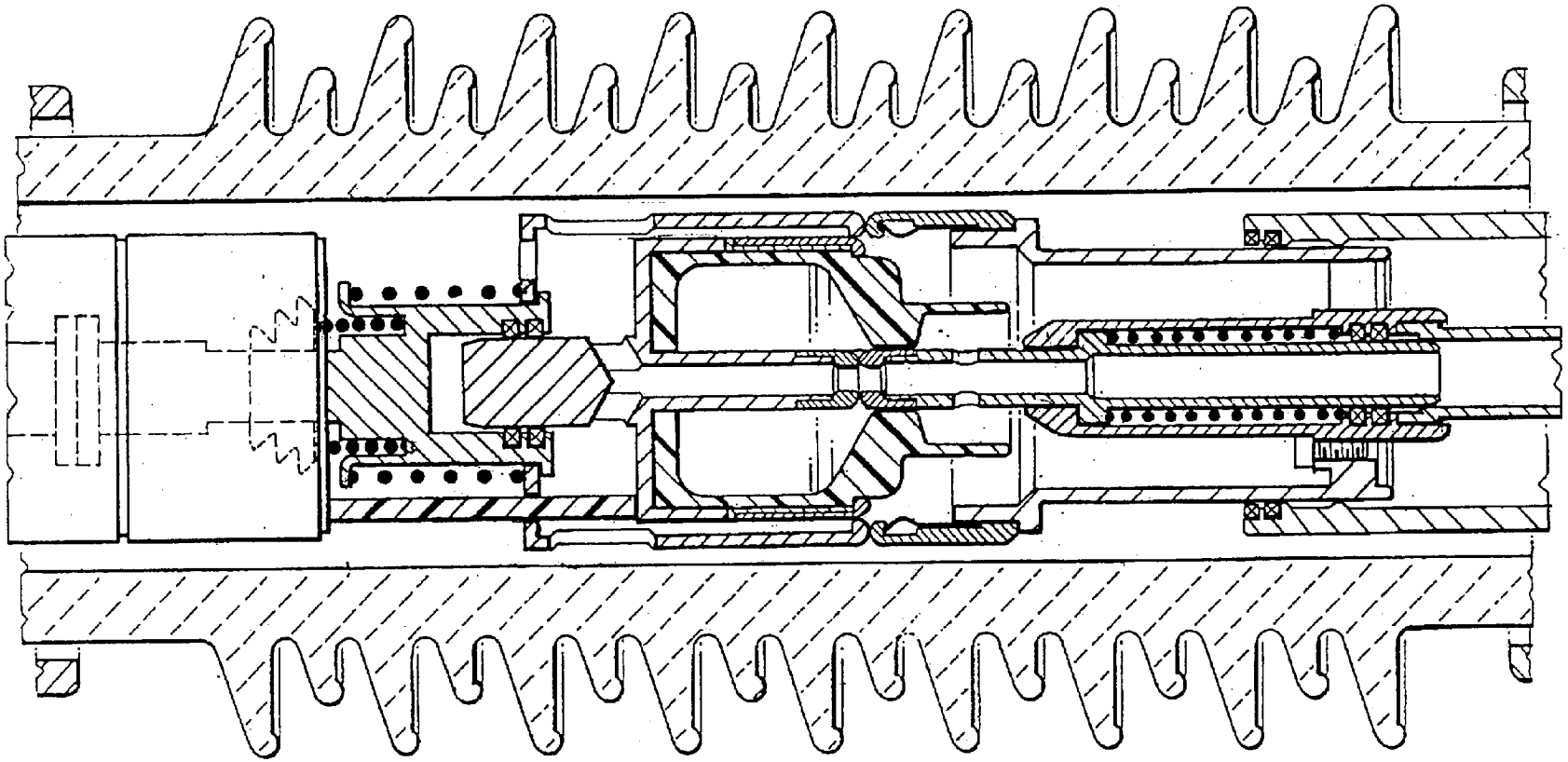
FIG. 11 represents a subsequent step of the opening of the hybrid breaker device shown in FIG. 10.

FIG. 11 shows the device from FIG. 10 at a time corresponding to the FIG. 2 stage.

The devices previously described with reference to FIGS. 1 to 11 do not always achieve efficient arc blow-out in the gas switch in all circumstances. In particular, if the current to be broken is not high enough to generate sufficient heat to cause the necessary pressure rise in the thermal blast volume, adding a top-up pneumatic blast volume can achieve a pressure rise sufficient for efficient arc blow-out, this is known in the art in conventional high-voltage circuit-breakers. It is to be noted that in a hybrid breaker device, the blow-out requirement is less than in a standard breaker device because the vacuum switch contributes to withstanding the remaking voltage.

Figure 12:
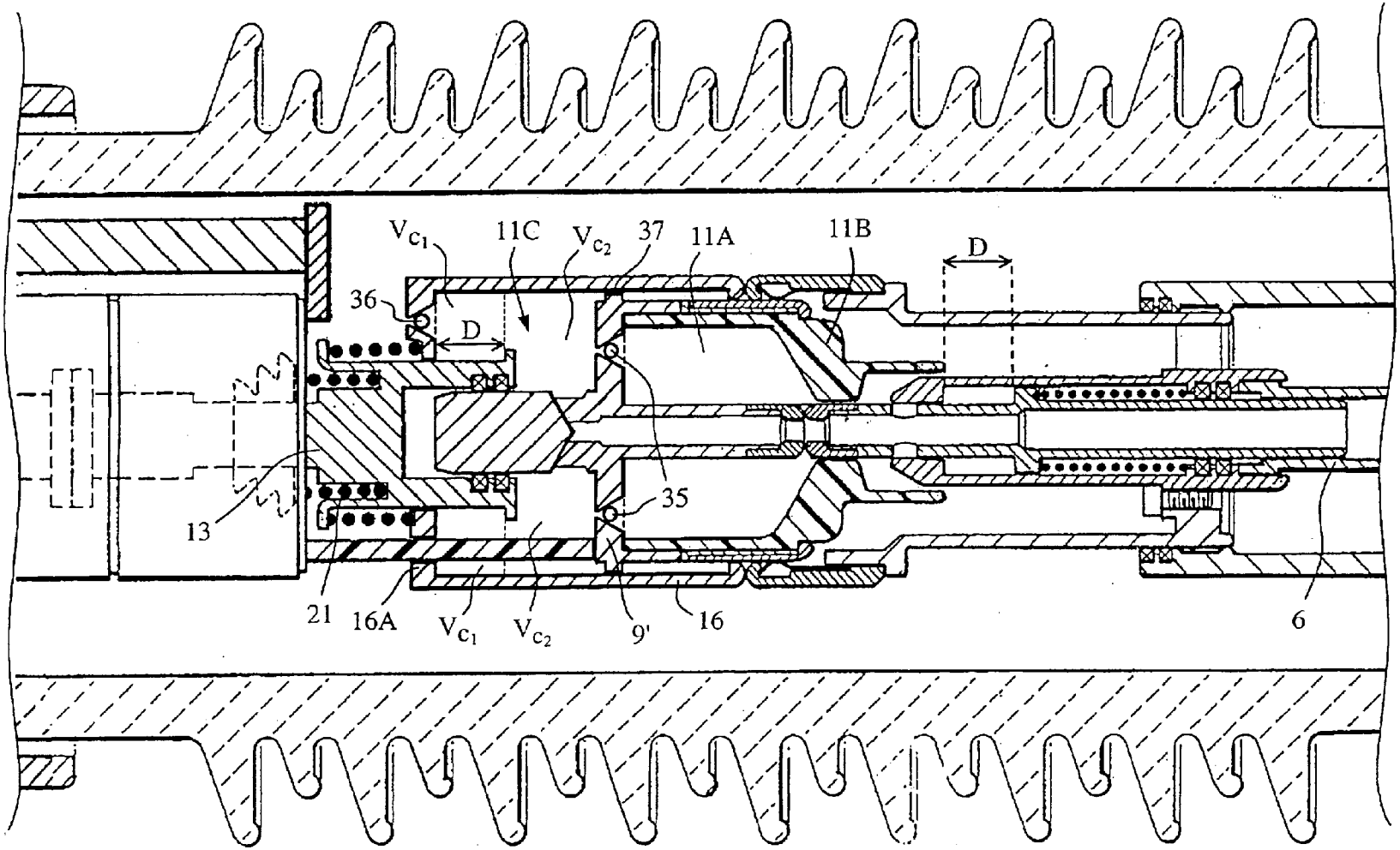
FIG. 12 is a partial diagrammatic representation of an embodiment of a hybrid breaker device incorporating a top-up pneumatic blast volume complementing the thermal blast volume in which the blast volumes are fixed.

FIG. 12 shows an embodiment of a hybrid high-voltage breaker device incorporating a top-up pneumatic blast volume 11C complementing a thermal blast volume 11A which is stationary. Many parts of the device are common to the device shown in FIG. 9, and in particular the contacts of the gas switch are disposed end-to-end in the closed configuration. The main modifications to be made to the FIG. 9 device to add the top-up pneumatic blast volume relate to the conductive wall 9' that forms the bottom of the thermal blast volume 11A and the first portion 16 of the movement transmission means of the device.

In the following description, the top-up pneumatic blast volume is also referred to as the compression volume, because thermal blow-out is assisted by compressing the gas in this supplementary volume.

As is known in the art, the thermal blast volume and the compression volume can communicate via valves, for example ball valves. This enables gases to pass from the compression volume to the thermal blast volume, initially during a first phase of the compression and then during the final phase of the compression in the case where the pressure rise generated by the thermal effect alone is insufficient to blow out the arc. This insufficiency is then compensated by a compressed gas top-up to the thermal blast volume. Conversely, in the case where the pressure rise generated by the thermal effect only in the volume 11A is sufficient and greater than the pressure rise obtained by pneumatic compression in the volume 11C, it is advantageous not to allow the gas to escape from the volume 11A to the volume 11C, in order not to reduce the effect of the thermal blow-out. Moreover, in an embodiment of a hybrid breaker device as shown in FIG. 12, and in the case of high currents to be broken, it is necessary to prevent the pressure rise in the compression volume 11C reaching excessive values that would tend to slow down or to block the action of the second spring 21 for opening the contacts of the vacuum switch. To this end, valves 35 are provided in the wall 9' of the volume 11A to provide the required functions of one-way gas flow or of isolation of the two blast volumes as a function of respectively low or high currents to be broken.

On the other hand, it is necessary to avoid creating a pressure drop in the pneumatic blast volume 11C at the end of closing the hybrid breaker device, in order to be able to compress the gas correctly if the device is to open again. To this end, it is advantageous to provide at least one valve 36, for example a ball valve, in the bottom of the compression volume, which is formed by an annular wall 16A which constitutes one end of the first portion 16 of the movement transmission means of the device.

Finally, the compression volume 11C must be sealed against the gas in the enclosure of the device during compression, so that the pressurized dielectric gas is channeled only toward the contacts of the gas switch for the blowing action. To seal this volume, it is possible to increase the diameter of the annular wall 9' of the volume 11A compared to the FIG. 9 embodiment of the device, to provide a gastight contact area 37 between the annular wall 9' and the cylindrical interior wall of the first portion 16 of the transmission means.

The compression volume 11C can be regarded as the combination of two adjacent partial volumes $Vc_1$ and $Vc_2$. The length of the volume $Vc_1$ in the longitudinal direction corresponds to the travel D indicated in the FIG. 1 theoretical diagram, which indicates that the compression volume 11C will be reduced to the volume $Vc_2$ if the first portion 16 of the transmission means has completed this travel D at a time that corresponds to the start of separation of the contacts of the gas switch. The volume 11C then continues to be compressed during the opening of the contacts of the vacuum switch by the second spring 21, since the first portion 16 of the transmission means is then constrained to move with the mobile contact of the vacuum switch and continues to move toward the annular wall 9'.

In the previous embodiment, in which the thermal blast volume in the breaker device is stationary, the compression travel in the pneumatic blast volume is at most equal to the sum of the distances D and $d_1$ previously defined. Accordingly, the compression volume is necessarily limited in the longitudinal direction. To obtain a high top-up pneumatic blowing action, it is then necessary to increase the radial dimensions of the compression volume and therefore in particular to increase the diameters of the annular walls 9' and 16A which delimit that volume. This results in an increase in the overall radial size of the breaker device.

For medium-voltage applications (voltages less than 72.5 kV), and in particular applications in which the insulation between the breaker chamber and the exterior environment is provided by a metal enclosure, it is generally possible to accommodate the required overall radial size of the device. On the other hand, this overall radial size can give rise to problems in applications where the breaker chamber is insulated by a porcelain enclosure.

Figure 13:
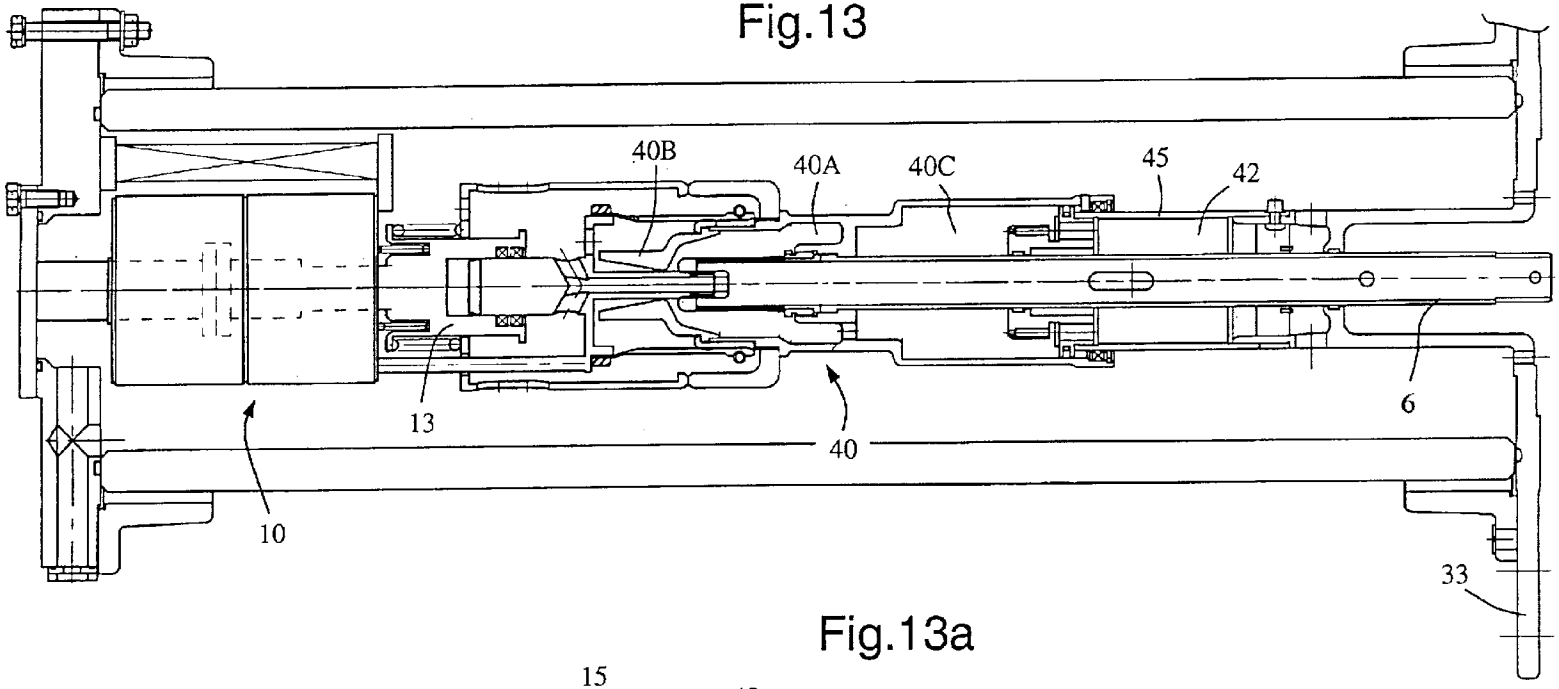
FIG. 13 is a diagrammatic representation of an embodiment of a hybrid breaker device in an embodiment in which the blast volumes move with the operating rod of the device.

FIG. 13 is a diagrammatic representation of one particular embodiment of a hybrid pneumatic blast breaker device. This embodiment differs from the previous ones in particular in that the thermal blast volume 40A and the pneumatic blast volume 40C of the gas switch 40 move with the operating rod 6 of the device.

The hybrid breaker device is shown closed. The contacts of the vacuum switch 10 are pressed together and the contacts of the gas switch are nested one within the other. The device has a number of similarities with that shown in FIG. 8. In particular, the vacuum switch 10, the connection means 13, and the first and second spring means can be identical in both embodiments.

Figure 13A:
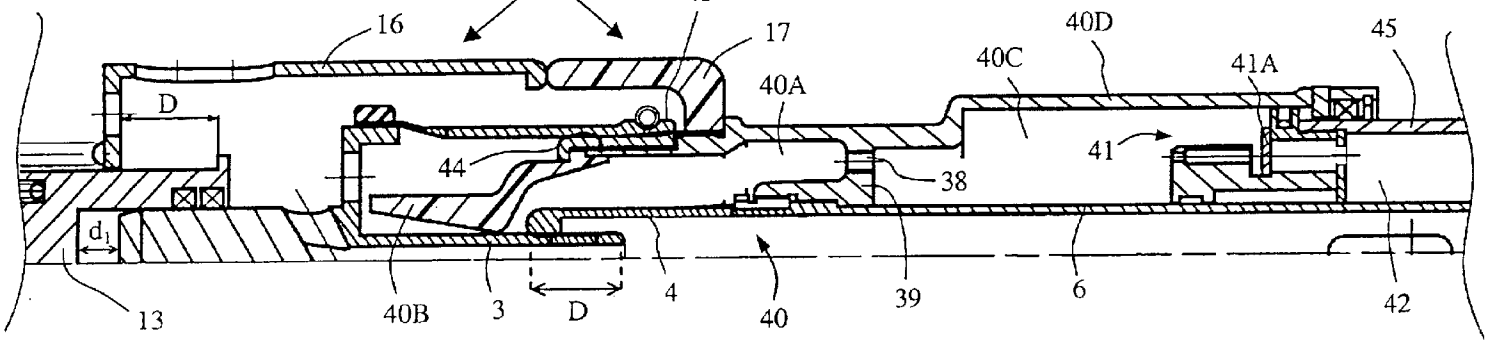
FIG. 13*a* is a view to a larger scale of a portion of the hybrid breaker device shown in FIG. 13.
Figure 19:
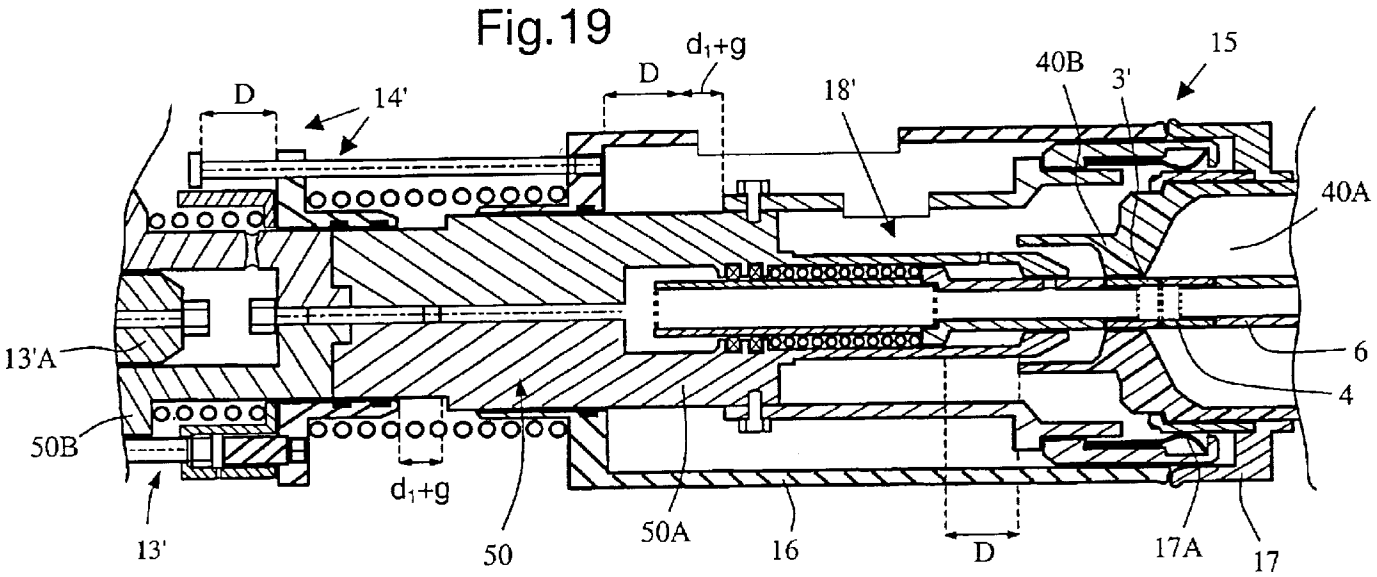
FIG. 19 is a diagrammatic representation of another embodiment of a hybrid breaker device according to the invention in which the contacts of the gas switch are disposed end-to-end.

FIG. 13*a* shows to a larger scale a portion of the device from FIG. 19 centered on the gas switch 40. As in the FIG. 8 device, the movement transmission means 15 comprise two portions 16 and 17 which are adapted to be moved conjointly when pressed one against the other and to be dissociated after the vacuum switch begins to open. The second portion 17 is constrained to move in translation with the operating rod 6, because this portion 17 is fixed to the periphery of an approximately cylindrically tubular wall 40D which provides the separation between the two blast volumes 40A and 40C and the gas contained in the enclosure of the device. The wall 40D is in effect connected to the operating rod in a fixed manner by an annular wall 39 which separates the two blast volumes.

Figure 14:
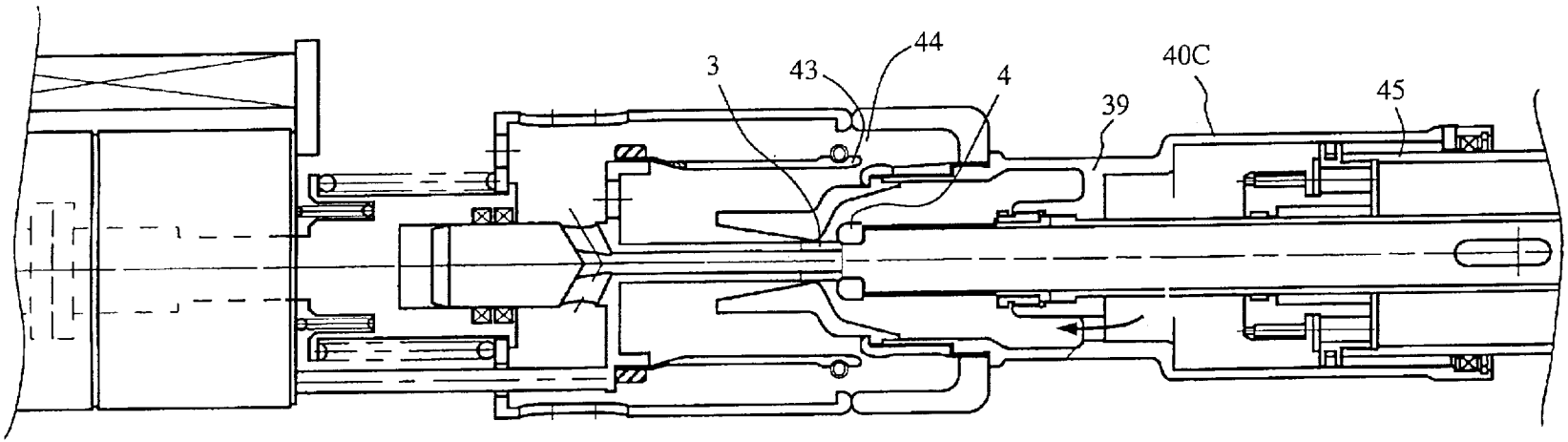
FIG. 14 represents an intermediate step of the opening of the hybrid breaker device shown in FIG. 13, corresponding approximately to the moment at which the contacts of the gas switch separate.
Figure 14:
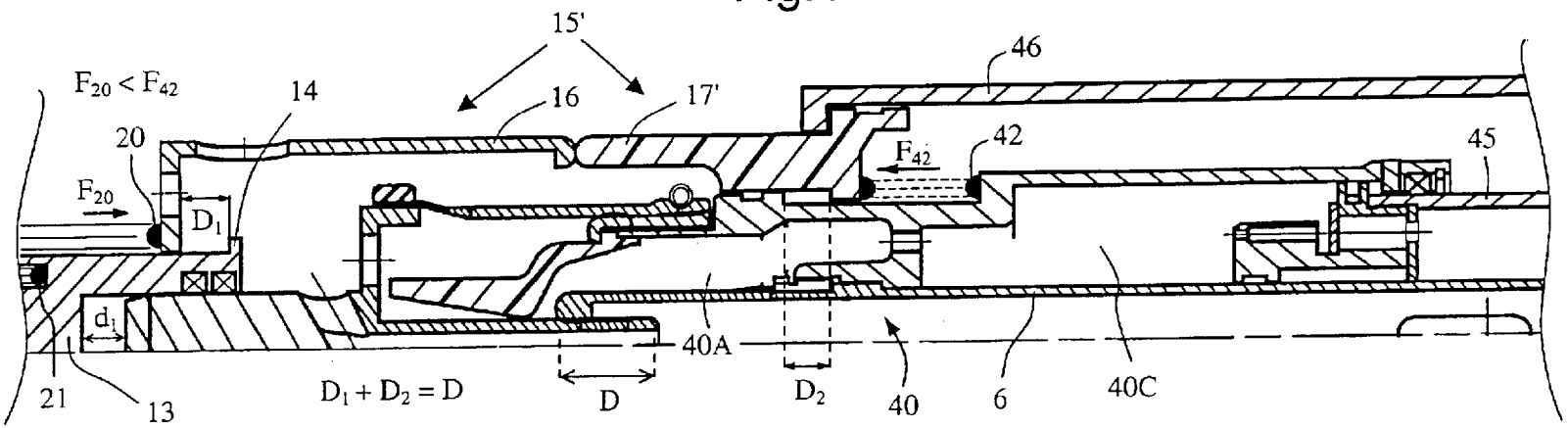

The thermal blast volume 40A is delimited at one end by a blast nozzle 40B fixed to one end of the wall 40D, so that the nozzle is constrained to move in translation with the operating rod 6. A permanent current contact 44 surrounds the end of the wall 40D and contributes to longitudinal retention of the nozzle against the wall, this contact therefore moving with the rod and the nozzle. The wall 40D is conductive and carries the permanent current from the contact 44 to a fixed tubular conductive member 45 which is electrically connected to a current terminal 33 of the breaker device; the wall 40D can slide in a sealed fashion along the tubular conductive member 45, remaining in electrical contact therewith. The permanent current mobile contact 44 has a tubular portion which is inserted into a tubular permanent current fixed contact 43 which is electrically connected to the connection means 13. The overlap distance of the permanent current contacts 43 and 44 is of course less than the overlap distance D of the arc contacts 3 and 4 of the gas switch 40, in order for these permanent current contacts to be able to separate before the arc contacts separate in turn on interrupting a current, as shown in FIG. 14.

The fixed conductive member 45 retains a sealing member 41 which has a fixed piston function for the compression volume 40C and is adapted to isolate the compression volume from the adjacent volume 42 delimited by the rod 6 and the tubular member 45. Here the sealing member 41 is provided with a valve 41A for allowing dielectric gas to pass from the volume 42 toward the compression volume 40C during closing of the hybrid breaker device, so preventing the creation of a pressure drop in that volume.

The annular wall 39 which separates the two blast volumes 40A and 40C has openings 38 to enable compressed gases to flow from the compression volume 40C to the thermal blast volume 40A. In the embodiment shown in the figure, these openings 38 are simple passages without valves, which proves satisfactory in a number of applications. For example, this embodiment is effective if the pneumatic compression blast which is effected to break low currents with short arc times needs only a relatively small thermal blast top-up to break high currents.

In a variant that is not shown in the figure, the openings 38 can also include valves, as is known in the art and in particular disclosed in the patent FR2751782. Furthermore, the sealing member 41 can be provided with a valve for limiting the pressure rise in the compression volume by allowing the pressurized gases to flow toward the volume 42.

FIG. 14 shows the hybrid breaker device from FIGS. 13 and 13*a* at an intermediate stage of its opening, approximately corresponding to the time at which the contacts 3 and 4 of the gas switch separate, i.e. when the mobile contact 4, which is constrained to move with the operating rod, has traveled the overlap distance D. At this moment, the annular wall 39 that separates the two blast volumes has moved the same distance D toward the fixed piston of the compression volume 40C, allowing the compressed dielectric gas to enter the thermal blast volume, as shown by an arrow in the figure.

Accordingly, after the arc contacts of the gas switch have separated, the arc is partly blown out thanks to pneumatic compression. It may be noted that this compression is effected throughout the travel of the operating rod, unlike previous embodiments in which the thermal blast volume is stationary in the device. A hybrid breaker device which includes a mobile thermal blast volume therefore has the advantage of being able to break currents with arc times that in principle are longer than for a device with a stationary thermal volume, as shown in FIG. 12. Furthermore, the longitudinal dimension of the compression volume 40C is not limited by the dead travel D, as previously, which provides a satisfactory compression volume without having to increase its radial dimension. Mobile thermal volume devices are therefore particularly well suited to applications in which the break chamber is insulated by a porcelain enclosure, and in general to high-voltage applications with voltages greater than approximately 100 kV.

FIG. 14' shows an embodiment of a hybrid breaker device similar to that shown in FIG. 14, although somewhat more complex. Although most of the components of this device are common to the previous device, some modifications have been made and further components added. In particular, the first spring means include, in addition to the first spring 20 another spring 42, these two springs being disposed one on each side of direction changer means 15'. The spring 42 is inserted between the second portion 17' of the direction changer means 15' and the tubular enclosure of the compression volume 40C. The two springs 20 and 42 cooperate so that the operating rod 6 can be moved over the dead travel D whilst maintaining some pressure between the contacts of the vacuum switch. However, only the first spring 20 has the function of maintaining this pressure, because a fixed tie-rod 46 fitted with an end stop immobilizes the second portion 17' against movement in translation to prevent the force $F_{42}$ applied by the spring 42 being added to the force $F_{20}$ applied by the first spring 20.

Figure 17:
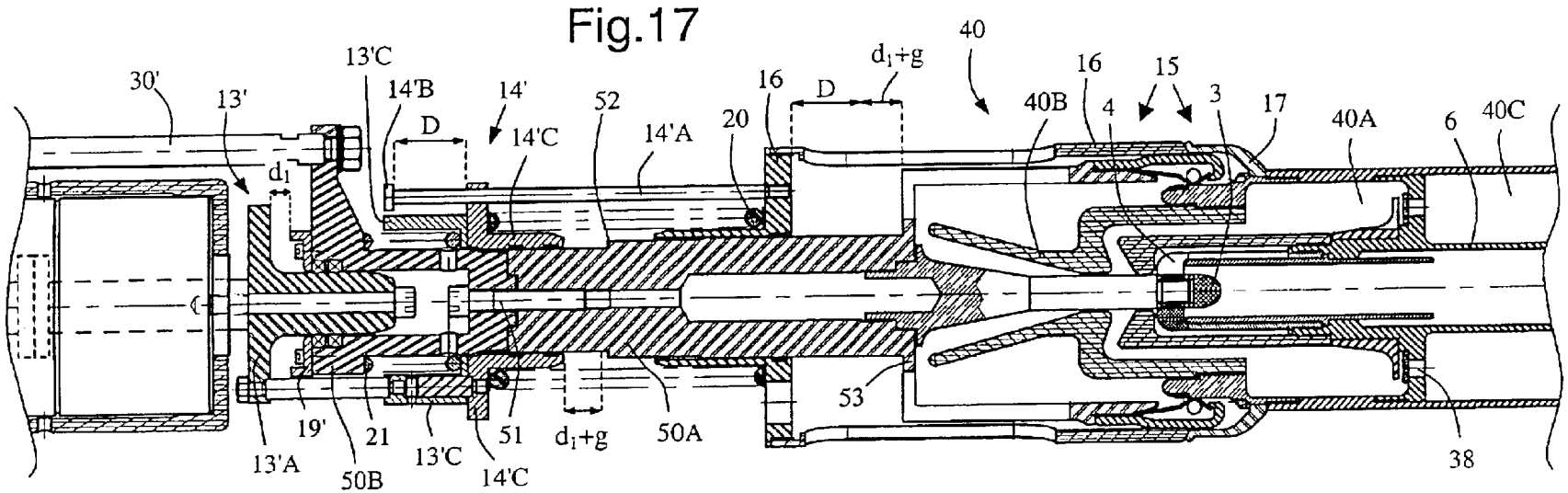
FIG. 17 is a diagrammatic representation of an embodiment of a hybrid breaker device according to the invention which is functionally equivalent to the device shown in FIG. 13 and which incorporates an improvement for preventing bouncing of the mobile contact of the vacuum switch.

The travel D1 over which the first portion 16 of the direction changer means 15' can be moved by the first spring 20 is significantly reduced compared to previous embodiments. Accordingly, the force $F_{20}$ applied by this spring varies less during an operation of opening or closing the hybrid breaker device, which limits the forces applied to the vacuum switch during the opening or closing of its contacts. The first spring means being intended to allow the displacement of the maneuvering rod 6 over a dead travel D, it is necessary for the spring 42 to be able to entrain the rod over a travel less than or equal to the distance D2 shown in the figure before the first spring 20 entrains the rod over the travel D1 via the direction changer means 15'. The sum of the two travels D1 and D2 must be equal to the dead travel D if simultaneous separation of the contacts of the gas and vacuum switches is required. Moreover, it is necessary for the force $F_{42}$ to be greater than the force $F_{20}$, at least in the closure position shown, to allow the first part 16 of the direction changer means 15' to travel the distance D1 only after the second portion 17' of the direction changer means 15' has been constrained to move with the maneuvering rod. It is possible to adapt the device shown in FIG. 14' to have a distance D1 that is relatively short compared to the distance D2, which limits the travel of the first portion 16 of the direction changer means 15'. This causes relatively limited bouncing of the portion 16 when it comes to abut against the shoulder 14 attached to the connecting means 13, and therefore limits the risk of further arcing in the vacuum switch. Nevertheless, even with this solution, it is difficult to prevent entirely bouncing of the portion 16, and it may prove beneficial to modify the device by making therein an improvement in accordance with the present invention as described with reference to FIGS. 17 and 18. In particular, it is possible to replace the first portion 16 and the parts situated to its left in FIG. 14' with a portion of the FIG. 17 device. In FIG. 17, the portion of the device situated to the left of the portion 16 is adapted to prevent bouncing movement of the mobile contact of the vacuum switch when the portion 16 has completed the dead travel D.

Figure 15:
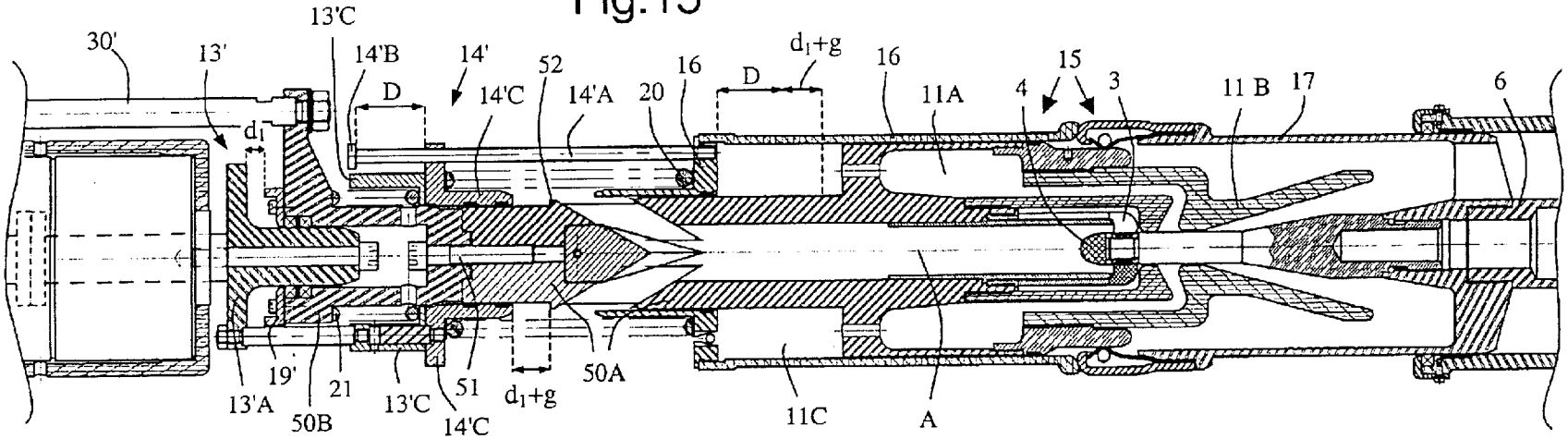
FIG. 15 is a diagrammatic representation of an embodiment of a hybrid breaker device according to the invention which is functionally equivalent to the device shown in FIG. 12 and which incorporates an improvement for preventing bouncing of the mobile contact of the vacuum switch.

FIG. 15 is a diagrammatic representation of one embodiment of a hybrid breaker device according to the invention. This embodiment is functionally equivalent to the device shown in FIG. 12 because the thermal blast volume 11A and the pneumatic blast volume 11C are fixed. They feature an improvement over the FIG. 12 device that prevents bouncing movement of the mobile contact of the vacuum switch, to avoid further arcing in this switch.

As in the device shown in FIG. 12, dead travel connecting means are adapted to allow movement of the rod 6 that carries the mobile contact 4 of the gas switch, and the vacuum switch is held closed during this movement, corresponding to a dead travel D. These means further comprise movement transmission means 15 that cooperate with a first spring 20 adapted to act on connection means to hold the vacuum switch closed. However, unlike those of the FIG. 12 device, here the dead travel connecting means are adapted to acquire a movement in translation that is independent of the movement acquired simultaneously by the connection means 13'.

In effect, in the embodiments of hybrid breaker devices shown in FIGS. 8 to 14 and 14', the first portion 16 of the movement transmission means becomes constrained to move with the connection means 13 once the portion 16 has completed the dead travel D or D1. These embodiments are not entirely satisfactory because, at the end of the dead travel, the portion 16 can bounce against the first abutment means 14 fastened to the connection means 13, so causing bouncing of the part 13. Because the connection means 13 are necessarily constrained to move with the mobile contact of the vacuum switch, bouncing of the part 13 implies analogous bouncing of the mobile contact relative to the fixed contact. This is not acceptable because the distance between the contacts of the vacuum switch is then significantly reduced in the phase corresponding to the start of the contact separation process, which is likely to cause further arcing in the switch.

As can be seen in FIG. 15, the dead travel connecting means comprise first abutment means 14' on which the first spring 20 bears to exert a force on the connection means 13'. The first abutment means 14' comprise at least one rod 14'A that is constrained to move with the first portion 16 of the movement transmission means 15 and which has at one end a head 14'B. Only one rod 14'A is shown in the figure, for clarity, but it is to be understood that a plurality of similar rods can be fixed to the first portion 16, for example disposed equidistantly around a circle whose center is on the longitudinal axis A of the device. Each rod is then the same length as the single rod shown, and has at one end a similar head 14'B. In an equivalent embodiment, the rod 14'A can consist of an angular portion of a tubular member whose axis coincides with the axis A of the device, and a head 14'B can then take the form of an angular portion of an annular member centered on the axis A.

The first abutment means 14' further include a first tubular bearing member 14'C which is adapted to be moved in the longitudinal axial direction A along a fixed support member 50 which it surrounds. In the embodiment shown in the figure, the fixed support member 50 comprises a first portion 50A which carries the fixed arc contract 3 of the gas switch and a second portion 50B which is held fixed in position by means of an insulative tie-rod 30' fixed to one end of the device. The second portion 50B holds the first portion 50A in place by means of fixing means 51 disposed along the axis A of the device, and is therefore electrically in contact with the latter.

The first tubular bearing member 14'C has an annular portion through which the rod(s) 14'A pass, so that each rod 14'A is able to slide through the member 14'C. Each head 14'B of a rod is adapted to abut against this annular portion once the dead travel D has been completed by each rod fastened to the first portion 16.

The first spring 20 is compressed between the annular portion of the first tubular member 14'C and the first portion 16 of the movement transmission means 15. During the expansion of the spring 20, which causes the movement over the dead travel D, the first tubular member 14'C continues to bear against the connection means 13' which is constrained to move with the mobile contact of the vacuum switch, which holds the vacuum switch closed. Once the dead travel D has been completed by the movement transmission means 15 and the rod(s) 14'A, the expansion of the spring 20 is suddenly interrupted, because each head 14'B of a rod abuts against the first tubular bearing member 14'C, this condition being referred to hereinafter as the coming into abutment of the first abutment 14'. The first tubular bearing member 14'C is then constrained to move with the first portion 16 of the movement transmission means 15, and because of this the first abutment means 14' cease to exert any force on the connection means 13', thus allowing the mobile contact of the vacuum switch to be moved by a second spring 21. The movement acquired by the first abutment means 14' with the first portion 16 is consequently independent of the movement of the connection means 13', and this has the advantage over the embodiments previously described that the speed of movement imposed on the mobile contact of the vacuum switch can be adjusted by altering only the characteristics of the second spring, without reference to the mass or the speed of the first portion 16.

Figure 16:
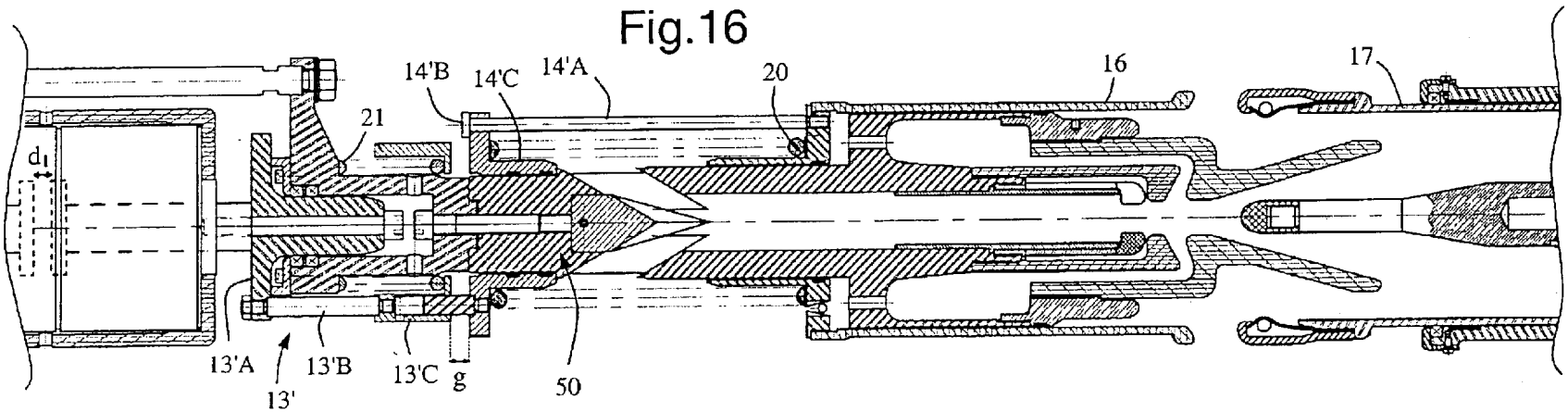
FIG. 16 shows the same hybrid breaker device as FIG. 15 at the end of opening of the contacts of the gas switch.

The authorized distance $d_1$+g for the movement of the first tubular bearing member 14'C along the fixed support member 50 advantageously exceeds the distance $d_1$ between the contacts of the vacuum switch by a particular clearance g referred to as the desolidarization clearance. It must be borne in mind that this distance $d_1$ is also the authorized distance for the movement of the connection means 13', and that the desolidarization clearance g consequently corresponds to the distance between the first tubular bearing member 14'C and the connection means 13' at the end of opening of the vacuum switch, as shown in FIG. 16. An annular shoulder 52 is formed on the first portion 50A of the fixed support member 50 in order to form a fixed end of travel abutment to stop the movement of the first member 14'C, and thus to stop the movement of the first abutment means 14' and that of the first portion 16 of the movement transmission means 15, shortly after the coming into abutment of the first abutment means 14'.

The connection means 13' have a main portion 13'A fixed to the mobile contact of the vacuum switch, comprising a cylindrical stud coaxial with the axis A of the device and provided at one end with an annular shoulder facing the vacuum switch. The other end of this cylindrical stud can slide in a cylindrical cavity of the same diameter formed in the second portion 50B of the fixed support member 50, also providing the electrical connection between the mobile contact of the vacuum switch and the fixed contact 3 of the gas switch, which is carried by the first portion 50A of the fixed support member 50. This second portion 50B has second abutment means 19' against which the annular shoulder of the main portion 13'A of the connection means 13' abuts when the latter has completed the isolating travel $d_1$ with the mobile contact of the vacuum switch.

To this annular shoulder of the main portion 13'A is fixed a tie-rod 13'B which attaches this portion 13'A to a second tubular bearing member 13'C which constitutes a secondary portion of the connection means 13'. This second tubular member 13'C surrounds the fixed support member 50 and is adapted to be moved along the latter in the axial direction A. Its first function is to transmit to the connection means 13' the force exerted by the first spring 20, to hold the contacts of the vacuum switch closed with a particular contact pressure. In this situation, it bears against the first tubular bearing member 14'C of the first abutment means 14'. On the other hand, it accommodates the second spring 21 between its internal cylindrical surface and the external cylindrical surface of the second portion 50B of the fixed support member 50, and has at its end facing the first abutment means 14' an annular shoulder for keeping the second spring 21 compressed. Thus the thrust exerted on this annular shoulder by the second spring 21 when it expands moves the whole of the connection means 13'.

As in the hybrid high-voltage breaker device shown in FIG. 12, the FIG. 15 device incorporates a top-up pneumatic blast volume 11C complementing the thermal blast volume 11A, which is stationary.

FIG. 16 shows the device from FIG. 15 at the end of breaking a current. Breaking began with the release of the operating rod of the gas switch, enabling the mobile contact of the gas switch to accelerate, in particular due to the thrust exerted by the first spring 20 on the movement transmission means 15, whose second portion 17 is constrained to move with the operating rod. This thrust of the first spring is exerted over the whole of the dead travel D completed by each rod 14'A of the first abutment means 14' conjointly with the first portion 16 of the movement transmission means 15. As soon as the dead travel D has been completed, the expansion of the first spring 20 is interrupted by the coming into abutment of the first abutment means 14' and the movement of the second portion 17 becomes independent of that of the first portion 16 of the movement transmission means 15.

Thereafter, the first portion 16 travels freely over a supplementary distance $d_1$+g conjointly with the first abutment means 14', mainly because of the kinetic energy previously acquired by this mobile assembly. The supplementary travel of this assembly is interrupted by the fixed abutment formed by the annular shoulder 52, as previously mentioned, at a longitudinal position in which the top-up pneumatic blast volume 11C is reduced to its minimum size. As in the embodiment shown in FIG. 12, the piston of the pneumatic blast volume is formed by an annular wall of the first portion 16 of the movement transmission means 15. Note that the compression in the volume 11C slows down the mobile assembly of the first abutment means 14' before it is stopped by the fixed abutment that the annular shoulder 52 forms.

A fixed abutment 52 of this kind is not indispensable, and a slightly different embodiment can be envisaged in which the piston formed by the annular wall of the first portion 16 comes into abutment against the wall separating the two blast volumes 11A and 11C once the additional travel $d_1$+g of the mobile assembly in question has been completed.

FIG. 16 represents the end of opening of the hybrid breaker device, which corresponds to a time after the step described hereinabove at which the travel of the first abutment means 14' is interrupted. The movement of the mobile contact of the gas switch has continued after this step, conjointly with the operating rod 6 and the second portion 17 of the movement transmission means 15, until a sufficient isolating distance is achieved for the arc contacts of the gas switch after the arc between these contacts has been blown out.

The mobile contact of the vacuum switch has traveled the separation distance $d_1$ conjointly with the connection means 13', the latter being pressed into abutment against the fixed support member 50 by the force exerted by the compressed second spring 21.

It is to be understood that the improvement in accordance with the invention, whereby a translation movement independent of that of the connection means can be imparted to the dead travel connecting means, can also be used in hybrid breaker devices that do not have any top-up pneumatic blast volume, for example the devices shown in FIGS. 8 and 9.

FIG. 17 shows diagrammatically an embodiment of a hybrid breaker device that is functionally equivalent to the device shown in FIG. 13, and which incorporates an improvement in accordance with the invention for preventing bouncing of the mobile contact of the vacuum switch.

Figure 18:
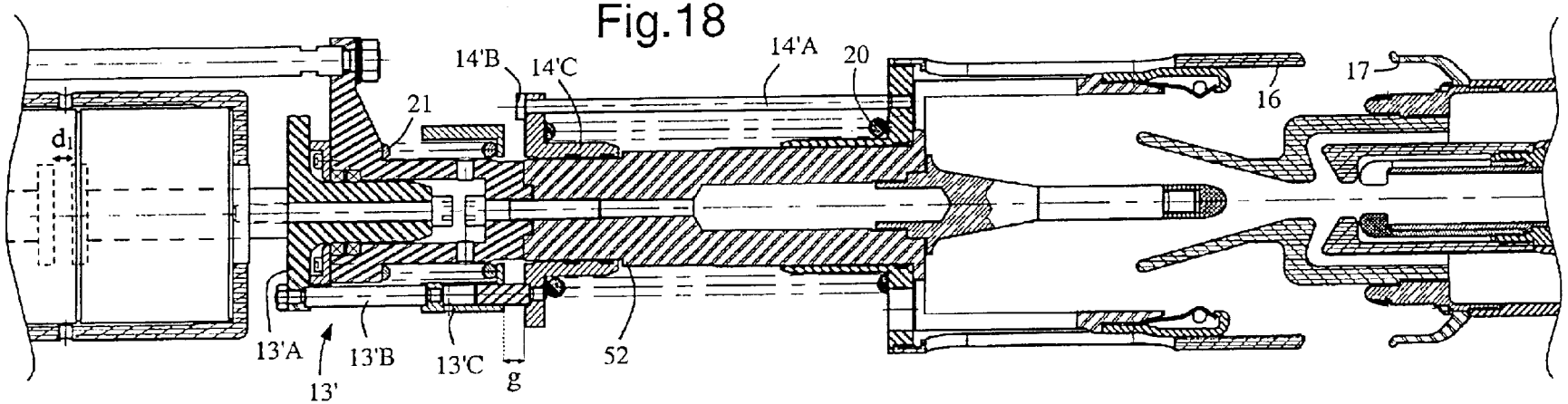
FIG. 18 shows the same hybrid breaker device as FIG. 17 at the end of opening of the contacts of the gas switch.

As in the FIG. 13 device, the gas switch 40 includes a thermal blast volume 40A and a pneumatic blast volume 40C that move with the operating rod 6 of the device. The fixed piston of the pneumatic blast volume 40C is not shown in the figure, but a piston like that of the sealing member 41 of the FIG. 13 device may be perfectly suitable for this purpose. Apart from the portions that are constrained to move with the operating rod, most components of the hybrid breaker device shown in FIGS. 17 and 18 are identical to the components of the device from FIGS. 15 and 16. Thus, the commentary on FIGS. 15 and 16 also explains the operation of this device.

Differing in this respect from the FIG. 15 embodiment, the additional travel $d_1$+g of the mobile assembly which comprises the first abutment means 14' and the first portion 16 of the movement transmission means is not interrupted in this embodiment by the annular shoulder 52, but instead by another annular shoulder 53 which forms a fixed abutment at the end of the fixed support member 50. This fixed abutment 53 is dimensioned to halt the translation movement of the first portion 16 at the end of the supplementary travel of the mobile assembly, since in this embodiment this movement is not braked by the compression in the pneumatic blast volume.

FIG. 18 shows the device from FIG. 17 at the end of opening of the contacts the gas switch. The commentary on FIG. 16 explains the stages of operation of the displacement means that are connected to the connection means 13' and to the operating rod 6 of the device.

Note that in this embodiment it is advantageous for the annular shoulder 52 to leave only a very small clearance with respect to the first tubular bearing member 14'C once the supplementary travel $d_1$+g has been completed by the first abutment means 14', to prevent the member 14'C continuing its translation movement by compressing the first spring 20 by virtue of its kinetic energy.

The desolidarization clearance g accommodates slight bouncing of the first abutment means 14' conjointly with the first portion 16 at the end of the supplementary travel $d_1$+g of the mobile assembly. Bouncing by a distance less than the clearance g does not affect the holding in abutment of the connection means 13' and therefore runs no risk of reducing the distance between the contacts of the vacuum switch.

FIG. 19 is a diagrammatic partial view of another embodiment of a hybrid breaker device according to the invention. The device as a whole can be extrapolated from the functionally equivalent device shown in FIG. 17, the blower nozzle 40B moving with the operating rod of the device in each of these embodiments. The structural differences relate to the implementation of the arc contacts 3' and 4 of the gas switch, which here are disposed end-to-end. See the description referring to FIGS. 9 and 7 for an explanation of the arrangement of the contacts which bear one against the other, in particular with regard to the structure of the means 18' for maintaining a pressure between the arc contacts of the gas switch to resist electrodynamic forces when a current is flowing. The structure of the means 18' for delaying the start of movement of the mobile contact in FIG. 19 is similar to that of the means 18 in FIG. 7.

Here the mobile contact 4 is fixed directly to the operating rod 6 and is therefore at all times constrained to move in translation with the rod. Note that this embodiment with contacts disposed end-to-end results in a relatively large thermal blast volume 11A for a limited overall radial size of the device, but this implies a significantly more complex implementation than when nested contacts are used, as in FIG. 13.

The means 18' for maintaining the contact pressure are mounted on the first portion 50A of the fixed support member 50 and support at one end the third arc contact 3', which here is not completely fixed, unlike that of the previous embodiments. The means 18' are adapted to allow the third arc contact 3' to move with the fourth arc contact 4 until these contacts separate, and thereafter to be held stationary in abutting relationship after this separation, whereas the fourth contact continues its travel conjointly with the operating rod when a current is interrupted by the device.

In this embodiment, the third arc contact 3' is referred to as quasi-fixed because it is mobile only during a relatively small portion of the total travel of the mobile arc contact 4. The third arc contact can therefore be configured to be quasi-fixed relative to the fourth arc contact. Note that in similar prior art embodiments of the means 18 for maintaining the contact pressure, a quasi-fixed arc contact is sometimes referred to as a semi-fixed contact.

For a hybrid breaker device according to the invention, the implementation of the arc contacts of the gas switch can generally use one or the other of the two technologies described herein, namely the nested contact technology with a particular overlap distance, or the technology using contacts disposed end-to-end with means for maintaining the contact pressure.

Figure 20:
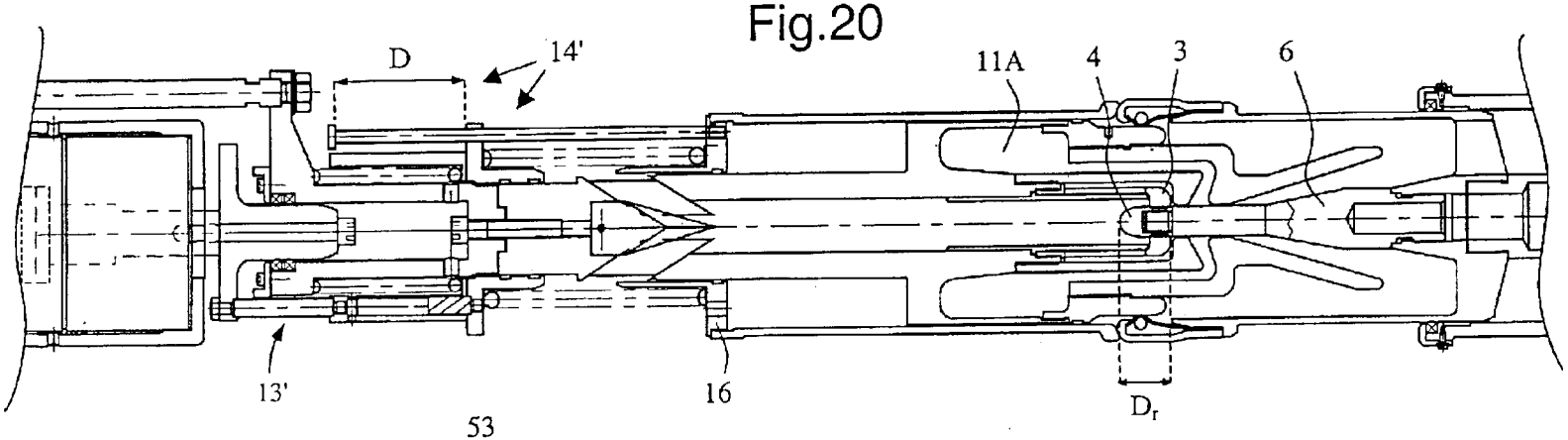
FIG. 20 is a diagrammatic representation of another embodiment of a hybrid breaker device according to the invention in which the device is intended for use as a generator circuit-breaker.

FIG. 20 shows another embodiment of a hybrid breaker device according to the invention intended for use as a generator circuit-breaker in a medium-voltage network. Here the displacement means connected to the connection means 13' and to the operating rod 6 of the device are such that the contacts of the vacuum switch separate with a significant delay relative to the separation of the arc contacts of the gas switch.

In effect, the overlap distance $D_r$ of the contacts 3 and 4 of the gas switch is here less than half the dead travel D of the first abutment means 14'. It must be borne in mind that this overlap distance is also called the acceleration distance, in particular in an equivalent embodiment in which the contacts of the gas switch are disposed end-to-end. As a general rule, for applications of the device as a generator circuit-breaker, it is preferable to choose a dead travel D greater than twice the acceleration distance of the mobile contact of the gas switch.

This means that an electrical arc is struck between the contacts of the gas switch, which have already separated by a particular distance before the dead travel D is totally completed, i.e. before the contacts of the vacuum switch separate. The gas switch is therefore in a position to cause the zero-crossing of the current before the vacuum switch breaks the current, which is an advantage in the context of use as a generator circuit-breaker.

It must be emphasized that a device of the above type must be capable of breaking short-circuit currents which are strongly asymmetrical, leading to delayed zero-crossings of the current. The hybrid breaker device shown reduces the asymmetry of the current and causes the zero-crossing of the current to occur sooner, at a time compatible with the operation of the vacuum switch.

The components of the device are for the most part similar to those of the device from FIGS. 15 and 16, with the notable difference that the thermal blast volume 11A is not backed up by a top-up pneumatic blast volume. In effect, unlike the previous device, here the gas switch is not required to break low currents, since in a medium-voltage network this role is provided by the vacuum switch, which is also capable of withstanding the remaking voltage.

Accordingly, the wall forming the bottom of the thermal blast volume 11A has no opening in it. Furthermore, the first portion 16 of the movement transmission means incorporates at least one opening intended to balance the gas pressure between the volume inside the portion 16 and the volume outside the displacement means, as in the device shown in FIGS. 17 and 18.

The length of the sliding rod of the first abutment means 14' must be increased compared to the device from FIG. 15 to increase the dead travel D, and the characteristics of the first spring are such that this spring always exerts sufficient pressure on the contacts of the vacuum switch, even when it has expanded over a distance close to the distance D just before these contacts separate.

In a hybrid breaker device according to the invention the thermal phase of breaking the current, i.e. the period of a few microseconds during which the remaking of the voltage begins, is assured for the most part by the vacuum switch of the device. The gas switch essentially contributes to withstanding the peak value of the voltage, thanks to the relatively large contact separation distance inherent to this type of switchgear, compared to a vacuum switch. In particular, this opens up the possibility of using a blast gas other than $SF_6$ in the gas switch. $SF_6$ is generally chosen for its ability to withstand high voltage remaking speeds during the thermal phase of breaking. Since the ability to withstand the transient remaking voltage during the thermal phase in a hybrid breaker device according to the invention is provided by the vacuum switch, another gas or gas mixture having sufficient dielectric properties can be used in the gas switch of the device. Nitrogen at a high pressure has the required dielectric properties for high voltages. Representing no risk to the environment, it is a preferred solution for using a gas other than $SF_6$. Alternatively, a mixture comprising more than 80% of nitrogen and some other gas such as $SF_6$ at least has the advantage of considerably reducing the risks to the environment compared to the use of pure $SF_6$.

What is claimed is:

1. A hybrid high-voltage or medium-voltage breaker device comprising:

an enclosure filled with a dielectric gas and having a longitudinal axis, a vacuum switch disposed in said enclosure, including a first pair of arc contacts comprising a first contact which is fixed and a second contact which can be moved in translation in the axial direction, pressure means adapted to exert on said second contact a force such that the mutual pressure between the bearing surfaces of said first and second contacts is greater than a particular value when said vacuum switch allows current to flow, a gas switch disposed in said enclosure, including a second pair of arc contacts comprising a third contact which is fixed or quasi-fixed and a fourth contact which can be moved in translation in said axial direction, an operating rod connected to said fourth contact and adapted to be immobilized or moved in translation by operating means, connection means for electrically connecting said second contact and said third contact, adapted to be moved in translation in said axial direction conjointly with said second contact, displacement means connected to said connection means and to said operating rod to move them to separate said second and fourth contacts from said first and third contacts, respectively, comprising dead travel connecting means connecting said connection means to said rod, said dead travel connecting means moving said rod over a particular dead travel at the same time as operating on said connection means to hold said vacuum switch closed during said movement, and in which device, when said dead travel has been completed by said rod, said dead travel connecting means are adapted to acquire a movement in translation in said axial direction which is independent of the movement acquired simultaneously by said connection means.

2. The breaker device claimed in claim 1, intended for use as a circuit-breaker in a high-voltage network, wherein said displacement means are such that the respective contacts of said vacuum switch and said gas switch separate simultaneously or with a short time-delay.

3. The breaker device claimed in claim 1, wherein said dead travel connecting means comprise movement transmission means which cooperate with first spring means adapted to act on said connection means to hold said vacuum switch closed and comprise first abutment means on which said first spring means bear to exert a force on said connection means, said first abutment means being adapted to cancel said force once said dead travel has been completed.

4. The breaker device claimed in claim 3, wherein said movement transmission means comprise two portions adapted to be moved conjointly, bearing one against the other, and to be dissociated after said vacuum switch begins to open.

5. The breaker device claimed in claim 3, wherein said first abutment means comprise at least one dead travel rod, which is constrained to move with a first portion of said movement transmission means and which has at one end a head, and a first tubular bearing member which is adapted to be moved in said axial direction along a fixed support member which surrounds it, said first tubular member having an annular portion through which said dead travel rod passes and against which said head is adapted to abut when said dead travel has been completed.

6. The breaker device claimed in claim 3, wherein said displacement means comprise second spring means adapted to separate said contacts of said vacuum switch as soon as said operating rod has completed said dead travel and to move said connection means and said second contact over a particular isolating travel relative to said first contact when a current is interrupted by said device, said isolating travel corresponding to the distance of complete separation of said first and second contacts.

7. The breaker device claimed in claim 5, wherein said first spring means comprise a first spring which is compressed between the annular portion of said first tubular bearing member and the first portion of said movement transmission means.

8. The breaker device claimed in claim 6, further comprising a fixed support member having first and second portions, and wherein said second spring means comprise a second spring compressed between said second portion of said fixed support member and an annular portion of a second tubular bearing member which surrounds said fixed support member, said second tubular bearing member being adapted to be moved along said fixed support member in said axial direction and being fastened by at least one tie-rod to a main portion of said connection means.

9. The breaker device claimed in claim 5, further comprising a second tubular bearing member and wherein said first tubular bearing member and said second tubular bearing member are stationary and bear one against the other, for as long as said dead travel has not been completed by said operating rod during interruption of current by said device.

10. The breaker device claimed in claim 8, wherein said second portion of said fixed support member is provided with second abutment means against which said main portion of said connection means abuts when the latter have completed said isolating travel.

11. The breaker device claimed in claim 8, wherein said first portion of said fixed support member supports the third arc contact and is supported by said second portion of said fixed support member by virtue of fixing means disposed along said axis of said device, said second portion being fixed in position by an insulative tie-rod which is fixed to one end of said device.

12. The breaker device claimed in claim 6, wherein a first portion of said movement transmission means is adapted to be moved over a total travel which is greater than the sum of said dead travel and said isolating travel that said second contact can complete.

13. The breaker device claimed in claim 4, wherein a second portion of said movement transmission means is constrained to move in translation with said operating rod.

14. A hybrid breaker device claimed in claim 1, further comprising a top-up pneumatic blast volume adjacent and able to communicate with a thermal blast volume and delimited by a fixed or mobile bottom which is adapted to be moved toward said thermal blast volume to compress the dielectric gas contained in said pneumatic blast volume during interruption of current by said device.

15. The hybrid breaker device claimed in claim 1, wherein said contacts of said gas switch are nested one within the other in the closed configuration with an overlap distance which is less than or equal to said dead travel.

16. The hybrid breaker device claimed in claim 1, wherein said contacts of said gas switch are abutted one against the other in the closed configuration and wherein means for delaying the onset of movement of said fourth contact are inserted between said contact and said rod.

17. The hybrid breaker device claimed in claim 1, wherein said arc contacts of said gas switch abut one against the other in the closed configuration, and wherein said pressure means for maintaining said contact pressure is adapted to allow one arc contact to be moved with the other contact until said contacts separate and to be held stationary after said separation.

18. The hybrid breaker device claimed in claim 1, intended to be used as a generator circuit-breaker for a medium-voltage network, wherein said displacement means are such that said contacts of said vacuum switch separate with a significant delay relative to the separation of said arc contacts of said gas switch, in order for the zero-crossing of the current to be caused by said gas switch before said vacuum switch breaks said current.

19. The hybrid breaker device claimed in claim 18, wherein said first abutment means of said dead travel connecting means are such that said dead travel is more than twice an acceleration distance of the mobile contact of said gas switch.

* * * * *